US012179953B2

(12) United States Patent
Colaone et al.

(10) Patent No.: US 12,179,953 B2
(45) Date of Patent: Dec. 31, 2024

(54) PACKAGING APPARATUS AND PROCESS

(71) Applicant: Cryovac, LLC, Charlotte, NC (US)

(72) Inventors: Matteo Colaone, Appiano Gentile (IT); Duncan George McIntyre, Northants (GB)

(73) Assignee: Cryovac, LLC, Charlotte, NC (US)

( * ) Notice: Subject to any disclaimer, the term of this patent is extended or adjusted under 35 U.S.C. 154(b) by 151 days.

(21) Appl. No.: 17/915,831

(22) PCT Filed: Mar. 24, 2021

(86) PCT No.: PCT/EP2021/057633
§ 371 (c)(1),
(2) Date: Sep. 29, 2022

(87) PCT Pub. No.: WO2021/197978
PCT Pub. Date: Oct. 7, 2021

(65) Prior Publication Data

US 2023/0132274 A1 Apr. 27, 2023

(30) Foreign Application Priority Data

Mar. 31, 2020 (EP) ..... 20167364

(51) Int. Cl.
*B65B 7/16* (2006.01)
*B65B 41/16* (2006.01)
*B65B 61/06* (2006.01)

(52) U.S. Cl.
CPC ..... *B65B 7/164* (2013.01); *B65B 41/16* (2013.01); *B65B 61/06* (2013.01)

(58) Field of Classification Search
CPC ..... B65B 7/164; B65B 41/12; B65B 41/16; B65B 61/06
See application file for complete search history.

(56) References Cited

U.S. PATENT DOCUMENTS

| | | | | |
|---|---|---|---|---|
| 2,762,720 | A | 9/1956 | Michel | |
| 3,491,510 | A * | 1/1970 | Sternau | B29C 66/24244 53/329.2 |
| 3,509,683 | A | 5/1970 | Sternau | |
| 3,673,760 | A | 7/1972 | Canamero et al. | |
| 5,916,613 | A | 6/1999 | Stockley, III | |
| 6,623,821 | B1 | 9/2003 | Kendig | |
| 7,211,306 | B2 | 5/2007 | Peiffer et al. | |
| 7,803,416 | B2 | 9/2010 | Roveda et al. | |
| 8,129,007 | B2 | 3/2012 | Forloni | |
| 2019/0092508 | A1 * | 3/2019 | Schubert | B65B 11/105 |
| 2019/0283913 | A1 * | 9/2019 | Ehrmann | B65B 61/02 |
| 2019/0329966 | A1 * | 10/2019 | Vadlja | B65B 13/20 |

(Continued)

*Primary Examiner* — Thomas M Wittenschlaeger
*Assistant Examiner* — Himchan Song
(74) *Attorney, Agent, or Firm* — Jon M. Isaacson

(57) ABSTRACT

An apparatus for packaging includes a film supplying station presenting a roll support configured to receive a feed roll and to rotate it around a respective unwinding axis to unroll consecutive portions of plastic film. A selected unrolled portion having width significantly greater than its length is positioned inside a packaging station with the width aligned along the alignment direction of a row of product loaded supports to be packaged. The packaging station heat seals the selected unrolled portion to the underlying row of product loaded supports.

17 Claims, 5 Drawing Sheets

(56) References Cited

U.S. PATENT DOCUMENTS

| | | | | |
|---|---|---|---|---|
| 2019/0359360 | A1* | 11/2019 | Palumbo | B65B 11/52 |
| 2020/0207496 | A1* | 7/2020 | Schwab | B29C 51/46 |
| 2021/0122505 | A1* | 4/2021 | Rizzi | B29C 65/7867 |
| 2022/0289415 | A1* | 9/2022 | Della Casa | B65B 35/24 |
| 2023/0166878 | A1* | 6/2023 | Ponti | B65B 9/067 53/461 |

* cited by examiner

FIG.5
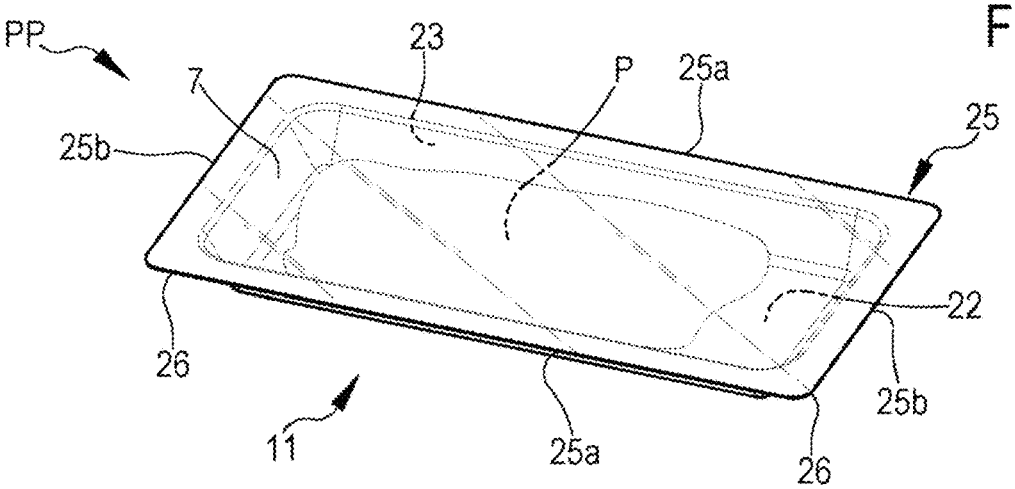
FIG.6
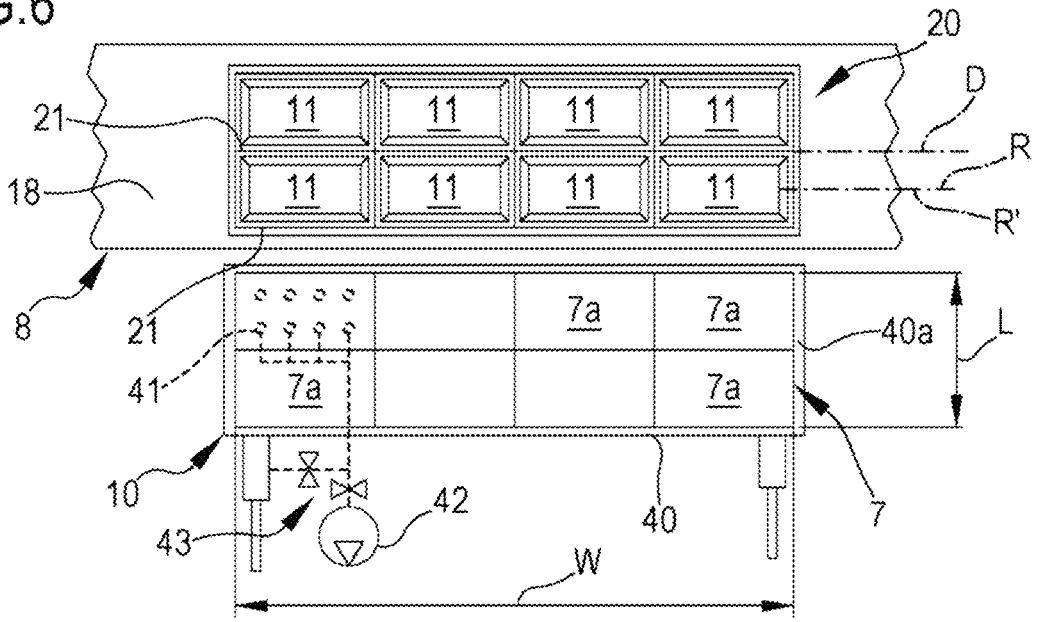
FIG.7
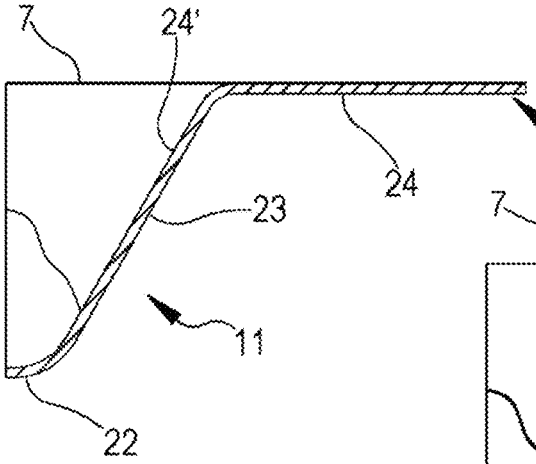
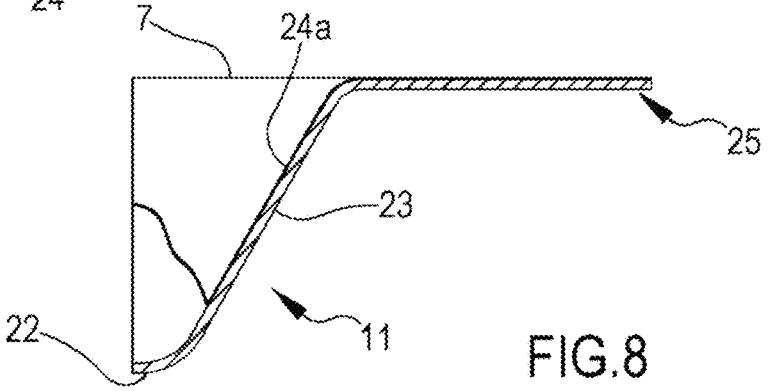
FIG.8

PACKAGING APPARATUS AND PROCESS

FIELD OF THE INVENTION

The present invention refers to an apparatus for making packages intended to house one or more products, which may be of various nature, for example food-type products. The invention also refers to a process of making said packages; the packages comprise a plastic support bearing the product which is sealed by a plastic film. The invention may find application for packaging in general, for vacuum packaging or for packaging under controlled atmosphere.

STATE OF THE ART

Several different apparatuses and related methods/processes are known for packaging articles like food products positioned on a support and then closed by a closure film.

In particular, packaging systems are known wherein a continuous plastic "bottom" film is unrolled along a machine working direction and subjected to thermoforming thereby defining a continuous precursor body having a plurality of cavities. The cavities in the precursor body receive corresponding products and are sealed by a top plastic film fed parallel to and above the precursor body to make a plurality of packages: the bottom and top plastic films are then cut to create separate finished packages.

In an alternative solution, a cutting station, placed upstream with respect to a thermoforming station, cuts discrete portions from a plastic "bottom" film and moves the film sheets to the thermoforming station; thermoformed supports obtained by the thermoforming station, which may be in the form of trays or flat supports, are then transferred to the subsequent packaging station where each tray or support is closed by a top plastic film.

In yet another alternative, preformed trays are moved on a transfer device to a packaging station. A film roll feeds a top plastic film which moves parallel and above the transfer device: the top plastic film is positioned in the packaging station where it is sealed to the underlying trays.

In the above solutions, the packaging station may be designed to contemporaneously process a plurality of trays or supports positioned according to one or more rows in order to maximize productivity. Consequently, at each packaging cycle, the top plastic film needs to cover one or more rows of trays/supports hosted in the packaging station, which means that, at each packaging cycle, a long piece of top plastic film is pulled and unwind from a supply roll in order to cover and seal all trays/support present in the packaging station. Due to the need of sealing a number of trays/supports in each single cycle (for example packaging machines may have packaging stations hosting two or more rows of trays/support with up to 5 or more trays per row) the length of film to be pulled and positioned above the trays/supports in the packaging station may be very long: for example longer than 1 m.

On the other hand, thin plastic films used as top closure films deviate from a perfectly straight configuration due to inherent inaccuracy in the film manufacturing processes currently adopted, or to other factors such as deformation imposed during winding/unwinding of the film, internal stresses in the film structure, etcetera. As a matter of fact, plastic films used as top closure films may present deviations from a straight configuration of the order of 30 or more mm every 10 linear meters, thus conferring an overall 'sneaky' configuration to the plastic film. This results in problems when a relatively long strip of film is pulled from the feed roll and moved to cover one or more rows of tray/supports in the packaging station: in fact, if the pulled film strip presents a 'snaky' configuration it may deviate from the supports/trays perimeter and thus be unable to perfectly close all trays. On the other hand, the only way today known to cope with the above problem is to use films much larger than the effective total width of the trays/supports rows to be covered, with evident waste of material and with the need to then trim the excess of film possibly present on the sealed trays/support.

AIM OF THE INVENTION

The object of the present invention is to solve at least one of the drawbacks and/or limitations of the prior art.

A first object of the invention is to provide a packaging apparatus and process, which while solving the described drawbacks also guarantees a high production yield.

Another object of the invention is to provide a packaging apparatus and process characterized by high production speed and reduced material scrap.

A further object of this invention is that of providing an apparatus and a process capable of processing a plurality of trays/supports in a same cycle guaranteeing perfect sealing of all trays/supports.

An additional object is that of providing a process and an apparatus for packaging products capable of improving positioning of the top closing film onto the trays or supports.

Furthermore, an ancillary object of the invention is that of offering a packaging apparatus and a packaging process suitable to form ermetically closed packages or packages under vacuum (i.e., vacuum skin packages) or packages under controlled atmosphere.

SUMMARY SECTION

One or more of the above objects are substantially reached by a packaging process and/or by a packaging apparatus according to one or more of the appended claims.

Aspects of the invention are here below described.

A 1$^{st}$ aspect concerns a process of packaging, the process comprising the following steps:

- positioning a plurality of supports (11), with a respective product (P) thereon, inside a packaging station (8) comprising a lower tool (18) and an upper tool (19) cooperating with the lower tool, wherein:
  - the supports (11) are positioned at a lower tool loading area (20) according to one or more parallel rows of supports (R),
  - each row of supports (R) includes a plurality of supports (11) aligned along a predetermined alignment direction (D),
- unrolling a top closure film (3) from a feed roll (2) of a film supplying station (1) by allowing the feed roll (3) to turn about a respective unwinding axis (A), the top closure film having a width (W) measured parallel to the unwinding axis (A),
- transferring a selected unrolled portion (7) of the top closure film (3) inside the packaging station (8), wherein the selected unrolled portion (7) is a strip spanning across and having same width (W) of the top closure film (3), and wherein said selected unrolled portion (7) is positioned above the lower tool loading area (20) with the width (W) of the selected unrolled portion (7) aligned to the alignment direction (D) of the rows of supports (R) present in the lower tool loading area (20), fixing the selected unrolled portion (7) of the top closure film (3) to the plurality of supports present in the packaging station.

In a $2^{nd}$ aspect according to the $1^{st}$ aspect fixing the selected unrolled portion (7) of the top closure film (3) to the plurality of supports present in the packaging station is achieved by heat sealing the selected portion of the top closure film to the plurality of supports present in the packaging station and in particular positioned at said lower tool loading area (20).

In a $3^{rd}$ aspect according to any one of the preceding aspects the number of aligned supports (11) in each row of supports (R) is greater than the number of support rows (R) present in the lower tool loading area (20).

In a $4^{th}$ aspect according to any one of the preceding aspects the support loading area (20) extends more along the alignment direction (D) than perpendicularly to the alignment direction (D).

In a $5^{th}$ aspect according to any one of the preceding aspects the support loading area (20) extends along the alignment direction (D) at least 1.5 times, preferably at least twice, than perpendicularly to the alignment direction (D).

In a $6^{th}$ aspect according to any one of the preceding aspects the supports (7) are positioned at the lower tool loading area (20) in correspondence of one or more rows of seats (R') comprising seats (21) aligned along the alignment direction (D).

In a $7^{th}$ aspect according to the preceding aspect each row of seats (R') comprises 3 or more seats (21) thus defining a respective row of supports (R) having 3 or more supports (11).

In a $8^{th}$ aspect according to any one of the preceding two aspects each row of seats (R') comprises 5 or more seats (21) thus forming a respective row of supports (R) having 5 or more supports (11).

In a $9^{th}$ aspect according to any one of the preceding three aspects, wherein the lower tool (18), at the lower tool loading area (20), has a plurality of parallel rows of seats (R') aligned along the alignment direction (D) and receives said supports (11) positioned according to said rows of supports (R).

In a $10^{th}$ aspect according to any one of the preceding four aspects the number of seats (21) on each row of seats (R') is at least twice the number of rows of seats (R') present in the lower tool loading area (20).

In a $11^{th}$ aspect according to any one of the preceding aspects the selected unrolled portion (7) of the top closure film transferred inside the packaging station and above the lower tool loading area is of rectangular shape.

In a $12^{th}$ aspect according to any one of the preceding aspects the selected unrolled portion (7) of the top closure film transferred inside the packaging station and above the lower tool loading area has:

width (W) sufficient to cover the extension along the alignment direction (D) of all supports in the packaging station, and length (L), measured perpendicular to said width (W), sufficient to cover the extension, perpendicular to said alignment direction (D), of all supports present in the packaging station.

In a $13^{th}$ aspect according to any one of the preceding aspects each one of the supports (11) is a tray having a base wall, a side wall emerging from the base wall and a top flange delimiting a top aperture of the tray and emerging radially from the base wall.

In a $14^{th}$ aspect according to the preceding aspect the flange has a rectangular external perimeter with two opposite first sides directed parallel to said alignment direction and two opposite second sides directed perpendicular to said alignment direction (D), wherein the width (W) of the selected unrolled portion transferred inside the packaging station and above the supports is at least equal to the measure of one first side times the number of supports present in each row, and wherein length (L) of the selected unrolled portion transferred inside the packaging station and above the supports is at least equal to the measure of one second side times the number of rows of supports present in the packaging station.

In a $15^{th}$ aspect according to any one of aspects from the $1^{st}$ to the $12^{th}$ each one of the supports (11) is a flat support having a rectangular external perimeter with two opposite first sides directed parallel to said alignment direction and two opposite second sides directed perpendicular to said alignment direction (D), wherein the width (W) of the selected unrolled portion transferred inside the packaging station and above the supports is at least equal to the measure of one first side times the number of supports present in each row, and wherein length (L) of the selected unrolled portion transferred inside the packaging station and above the supports is at least equal to the measure of one second side times the number of rows of supports present in the packaging station.

In a $16^{th}$ aspect according to any one of the preceding aspects the selected unrolled portion (7) of the top closure film transferred inside the packaging station and above the lower tool loading area is a transversal, full-width, elongated strip of the top closure film.

In a $17^{th}$ aspect according to any one of the preceding aspects the selected unrolled portion (7) of the top closure film transferred inside the packaging station and above the lower tool loading area has width (W) significantly greater than the respective length (L), this latter measured perpendicular to said width (W).

In a $18^{th}$ aspect according to any one of the preceding aspects the selected unrolled portion (7) of the top closure film transferred inside the packaging station and above the lower tool loading area has width (W) at least twice the respective length (L), this latter measured perpendicular to said width (W).

In a $19^{th}$ aspect according to any one of the preceding aspects the selected unrolled portion (7) of the top closure film transferred inside the packaging station and above the lower tool loading area has width (W) at least 3 times the respective length (L), this latter measured perpendicular to said width (W).

In a $20^{th}$ aspect according to any one of the preceding aspects the selected unrolled portion (7) of the top closure film transferred inside the packaging station and above the lower tool loading area has width (W) at least 5 times the respective length (L), this latter measured perpendicular to said width (W).

In a $21^{st}$ aspect according to any one of the preceding aspects the selected unrolled portion (7) of the top closure film transferred inside the packaging station and above the lower tool loading area has width (W) at least 10 times the respective length (L), this latter measured perpendicular to said width (W).

In a $22^{nd}$ aspect according to any one of the preceding aspects the process comprises repeating at intervals a packaging cycle comprising at least the following steps:

configuring the packaging station (8) in an open configuration, where the upper and lower tools are spaced apart the one from the other, with the packaging station in the open configuration executing said step of positioning the supports (11), with at least a product loaded thereon, in the packaging station (8), executing said step of transferring said unrolled portion (7) into the packaging station (8) and above the lower tool loading area (20), configuring the packaging station (8) in a closed configuration, wherein the upper and lower tools are approached to each other, with the packaging station (8) in a closed configuration, fixing the top closure film (3) to the supports.

In a 23$^{rd}$ aspect according to any one of the preceding aspects the process comprises repeating at intervals a packaging cycle comprising at least the following steps:

configuring the packaging station (8) in an open configuration, where the upper and lower tools are spaced apart the one from the other, with the packaging station (8) in the open configuration executing said step of positioning the supports (11), with at least a product loaded thereon, in the packaging station (8), executing said step of transferring said unrolled portion (7) into the packaging station (8) and above the lower tool loading area (20), configuring the packaging station (8) in a closed configuration, wherein the upper and lower tools are approached to each other, with the packaging station (8) in a closed configuration, heat sealing to the supports said selected portion (7) the top closure film (3) which has been transferred into the packaging station (8) and above the lower tool loading area (20).

In a 24$^{th}$ aspect according to any one of the preceding aspects the process comprises a cutting procedure executed at a cutting station (9) operatively interposed between the supplying station (1) and the transfer device (10), wherein the cutting station receives the top closure film and separates from it said selected unrolled portion (7) before it is transferred inside the packaging station (8).

In a 25$^{th}$ aspect according to any the preceding aspect the cutting procedure comprises to transversally separate the selected unrolled portion (7) from the top closure film (3), forming a separated unrolled portion, divided from the rest of the closure film coming from the feed roll, in the form of a unitary strip having the same width (W) of the top closure film.

In a 26$^{th}$ aspect according to any one of the preceding aspects from the 1$^{st}$ to the 24$^{th}$ the cutting procedure comprises to transversally separate said selected unrolled portion (7) from the top closure film (3) and longitudinally divide the closure film at said selected unrolled portion, forming a separated unrolled portion constituted by a plurality of longitudinally separated and transversally adjacent distinct film sheets (7*a*).

In a 27$^{th}$ aspect according to any one of the preceding three aspects the separated unrolled portion (7) is sized exactly to cover all supports (11) of a same row of supports (R) present in the packaging station (8) and to cover all rows of supports present in the packaging station (8).

In a 28$^{th}$ aspect according to any one of the preceding four aspects the separated unrolled portion (7) once transferred into the sealing station is engaged to the underlying supports (11) present in the lower tool load area (20) such that each one of the supports (11) is heat sealed to a respective part of the separated unrolled portion (7) or to a respective one of the distinct film sheets (7*a*).

In a 29$^{th}$ aspect according to any one of the preceding aspects the width of the top closure film (3), measured parallel to said unwinding axis (A), and thus the width (W) of each selected unrolled portion (7), is at least 450 mm.

In a 30$^{th}$ aspect according to any one of the preceding aspects the width of the top closure film (3), measured parallel to said unwinding axis (A), and thus the width (W) of each selected unrolled portion (7), is at least at least 600 mm.

In a 31$^{st}$ aspect according to any one of the preceding aspects the width of the top closure film (3), measured parallel to said unwinding axis (A), and thus the width (W) of each selected unrolled portion (7), is at least at least 1000 mm.

In a 32$^{nd}$ aspect according to any one of the preceding aspects the width of the top closure film (3), measured parallel to said unwinding axis (A), and thus the width (W) of each selected unrolled portion (7), is 1200 mm.

In a 33$^{rd}$ aspect according to any one of the preceding aspects the top closure film (3) is a plastic film.

In a 34$^{th}$ aspect according to any one of the preceding aspects the top plastic film (3) is an extruded mono or multilayer plastic film.

In a 35$^{th}$ aspect according to any one of the preceding aspects the top closure film (3) has a thickness comprised between 10 and 200 μm.

In a 36$^{th}$ aspect according to any one of the preceding aspects the step of transferring comprises:

positioning the selected unrolled portion (7) on an active surface (40*a*) of a transfer body (40), with the packaging station (8) in the open configuration, moving the transfer body (40) and thus the selected unrolled portion (7) from the cutting station (9) to the packaging station (8), underneath the upper tool, releasing the selected unrolled portion (7) from the active surface (40*a*) of the transfer body (40) and capturing the same selected unrolled portion (7) by a lower surface of the upper tool (19), returning the transfer body (40) to the cutting station (9).

In a 37$^{th}$ aspect according to the preceding aspect the active surface of the transfer body (40) is flat.

In a 38$^{th}$ aspect according to any one of the preceding two aspects wherein the active surface of the transfer body (40) keeps the selected unrolled portion in position under a suction force exerted by sucking air through a plurality of suction holes (41) present on said active surface and connected to a vacuum source (42).

In a 39$^{th}$ aspect according to any one of the preceding three aspects wherein the active surface of the transfer body (40) keeps the selected unrolled portion (7) while moving the transfer body (40) from the cutting station (9) to the packaging station (8) and until releasing under the action of a suction force exerted by sucking air through a plurality of suction holes (41) present on said active surface and connected to a vacuum source (42).

In a 40$^{th}$ aspect according to any one of the preceding aspects wherein transferring comprises grasping the leading edge (7*b*) of the selected unrolled portion (7) and moving this latter from a pick up zone outside the packaging station into the packaging station and above the lower tool loading area.

In a 41$^{st}$ aspect according to any one of the preceding aspects wherein transferring the unrolled selected portion (7) into the packaging station (8) is effected without grasping opposite longitudinal side borders of said selected unrolled portion.

In a 42$^{nd}$ aspect according to any one of the preceding aspects wherein transferring the unrolled selected portion (7) from the cutting station into the packaging station is effected without grasping opposite longitudinal side borders of said selected unrolled portion.

In a 43$^{rd}$ aspect according to any one of the preceding aspects wherein transferring the unrolled selected portion (7) into the packaging station is effected without using conveying elements such as pincers grasping the longitudinal side borders of said selected unrolled portion.

In a 44$^{th}$ aspect according to any one of the preceding aspects wherein transferring the unrolled selected portion (7) from the cutting station into the packaging station is effected without using conveying elements such as pincers grasping the longitudinal side borders of said selected unrolled portion.

A 45$^{th}$ aspect concerns a packaging apparatus (100) comprising:

a film supplying station (1) for supplying a top closure film (3), wherein the film supplying station (1) is configured to engage at least one feed roll (2) for rotation about a respective unwinding axis (A) to allow unrolling of said top closure film (3) from the feed roll (2), a packaging station (8) having:

a lower tool (18) presenting a lower tool loading area (20) configured to receive a plurality of supports (11) positioned according to one or more rows of supports (R), with each row of supports (R) including a plurality of supports (11) aligned along a predetermined alignment direction (D), an upper tool (19) configured for cooperating with the lower tool (18) for fixing the top closure film (3) to the plurality of supports (11) present in the packaging station (8);

a transfer device (10) configured to:

act on a selected unrolled portion (7) of said top closure film having same width (W), measured parallel to the unwinding axis (A), of the top closure film (3), and transfer said selected unrolled portion (7) into said packaging station (8) and above the lower tool loading area (20), with the width (W) of each selected unrolled portion (7) aligned to the alignment direction (D) of the rows of supports (R) in the lower tool loading area.

In a 46$^{th}$ aspect according to the preceding aspect the lower tool loading area is configured such that the number of supports (11) in each row of supports (R) is greater than the number of rows of supports (R) in the same lower tool loading area.

In a 47$^{th}$ aspect according to any one of the preceding two aspects the support loading area (20) extends more along the alignment direction (D) than perpendicularly to the alignment direction (D).

In a 48$^{th}$ aspect according to any one of the preceding three aspects the lower tool (18), at the lower tool loading area (20), has one or more rows of seats (R') aligned along the alignment direction (D) and configured for receiving said supports (11) positioned according to said one or more rows of supports (R).

In a 49$^{th}$ aspect according to the preceding aspect each row of seats (R') comprises 3 or more aligned seats (21).

In a 49$^{th}$ aspect according to the preceding aspect each row of seats (R') comprises 5 or more, aligned seats (21).

In a 50$^{th}$ aspect according to any one of the preceding three aspects the lower tool (18), at the lower tool loading area (20), has a plurality of parallel rows of seats (R') aligned along the alignment direction (D) and configured for receiving said supports (11) positioned according to said rows of supports (R); and wherein the number of seats (21) on each row of seats (R') is at least twice the number of rows of seats (R') present in the lower tool loading area (20).

In a 51$^{st}$ aspect according to any one of the preceding aspects from the 45$^{th}$ to the 50$^{th}$ the transfer device (10) is configured to:

act on one selected unrolled portion (7) located at a pick-up zone (6) of the apparatus positioned between the film supplying station (1) and the packaging station (8), and transfer above the lower tool loading area (20), said selected unrolled portion (7) of said top closure film (3) having width (W) greater than the respective length (L).

In a 52$^{nd}$ aspect according to the preceding aspect wherein the transfer device (10) is configured to act on, and transfer above the lower tool loading area (20), one selected unrolled portion (7) of said top closure film (3) having width (W) at least twice the respective length (L).

In a 53$^{rd}$ aspect according to the preceding aspect wherein the transfer device (10) is configured to act on, and transfer above the lower tool loading area (20), one selected unrolled portion (7) of said top closure film (3) having width (W) at least 3 times the respective length (L).

In a 54$^{th}$ aspect according to the preceding aspect wherein the transfer device (10) is configured to act on, and transfer above the lower tool loading area (20), one selected unrolled portion (7) of said top closure film (3) having width (W) at least 5 times the respective length (L).

In a 55$^{th}$ aspect according to the preceding aspect wherein the transfer device (10) is configured to act on, and transfer above the lower tool loading area (20), one selected unrolled portion (7) of said top closure film (3) having width (W) at least 10 times, the respective length (L).

In a 56$^{th}$ aspect according to any one of the preceding aspects from the 45$^{th}$ to the 55$^{th}$ wherein the transfer device (10) is configured to:

act on one selected unrolled portion (7) located at a/the pick-up zone (6) of the apparatus positioned between the film supplying station (1) and the packaging station (8), and transfer above the lower tool loading area (20), said selected unrolled portion (7) of said top closure film (3), said selected unrolled portion (7) of said top closure film (3) having:

width (W) sufficient to cover the entire extension, along said alignment direction (D), of the lower tool loading area (20), in particular to cover all supports (11) of a same row of supports (R) present in the packaging station (8), length (L) sufficient to cover the entire extension, perpendicular to said alignment direction (D), of the lower tool loading area (20), in particular to cover all rows of supports (R) present in the packaging station (8).

In a 57$^{th}$ aspect according to any one of the preceding aspects from the 45$^{th}$ to the 56$^{th}$ wherein the transfer device (10) is configured to:

act on one selected unrolled portion (7) located at a/the pick-up zone (6) of the apparatus positioned between the film supplying station (1) and the packaging station (8), and transfer above the lower tool loading area (20), said selected unrolled portion (7) of said top closure film (3), said selected unrolled portion (7) of said top closure film (3) having:

width (W) sufficient to cover the entire extension, along said alignment direction (D), of the lower tool loading area (20), and to cover all supports (11) of a same row of supports (R) present in the packaging station (8), length (L) sufficient to cover the entire extension, perpendicular to said alignment direction (D), of the lower tool loading area (20), and to cover all rows of supports (R) present in the packaging station (8).

In a 58$^{th}$ aspect according to any one of the preceding aspects from the 45$^{th}$ to the 57$^{th}$ the packaging apparatus (100) comprises a control unit (50) communicatively connected to the packaging station (8) and to the transfer device (10).

In a 59$^{th}$ aspect according to the preceding aspect the control unit is configured to execute the steps of the process of any one of the aspects from the 1$^{st}$ to the 44$^{th}$.

In a 60$^{th}$ aspect according to any one of the preceding two aspects the control unit (50) is configured to execute a packaging cycle comprising at least the following steps:

command the packaging station (8) to position in an open configuration, where the upper and lower tools (18, 19) are spaced apart the one from the other to allow positioning of the supports (11) in the packaging station;

with the packaging station (8) in the open configuration, command the transfer device (10) to act on one of the selected unrolled portions (7) of the top closure film (3) and transfer said selected unrolled portion (7) into the packaging station (8) and above the lower tool loading area (20), with the width (W) of each selected unrolled portion (7) being aligned to the alignment direction (D) of the rows of supports (R) in the lower tool loading area (20), commanding the packaging station (8) to position in a closed configuration, wherein the upper and lower tools (18, 19) are approached to each other and cooperate to fix the top closure film (3) to the supports, in particular to heat seal the selected unrolled portion (7) of top closure film to the supports.

In a 61$^{st}$ aspect according to any one of the preceding aspects from the 45$^{th}$ to the 60$^{th}$ the film supplying station (1) is configured to engage said at least one feed roll (2) for rotation about the respective unwinding axis (A) which is parallel to said predetermined alignment direction (D).

In a 62$^{nd}$ aspect according to any one of the preceding aspects from the 45$^{th}$ to the 61$^{st}$ the packaging apparatus further comprises a cutting station (9) operatively interposed between the film supplying station (1) and the transfer device (10).

In a 63$^{rd}$ aspect according to the preceding aspect the cutting station is communicatively connected to and controlled by the control unit.

In a 64$^{th}$ aspect according to any one of the preceding two aspects the cutting station (9) is configured to transversally separate the selected unrolled portion (7) from the top closure film (3), forming a separated unrolled portion, divided from the rest of the closure film coming from the feed roll, in the form of a unitary strip having the same width (W) of the top closure film (3).

In a 65$^{th}$ aspect according to any one of the preceding aspects 62$^{nd}$ or 63$^{rd}$ the cutting station (9) is configured to transversally separate said selected unrolled portion (7) from the top closure film (3) and longitudinally divide the closure film (3) at said selected unrolled portion (7), forming a separated unrolled portion constituted by a plurality of longitudinally separated and transversally adjacent distinct film sheets (7*a*).

In a 66$^{th}$ aspect according to any one of the preceding aspects from the 45$^{th}$ to the 65$^{th}$ the film supplying station (1) engages one feed roll (2) providing the top closure film (3) of width (W), measured parallel to said unwinding axis (A), of at least 450 mm.

In a 67$^{th}$ aspect according to any one of the preceding aspects from the 45$^{th}$ to the 66$^{th}$ the film supplying station (1) engages one feed roll (2) providing the top closure film (3) of width (W), measured parallel to said unwinding axis (A), of at least 600 mm.

In a 68$^{th}$ aspect according to any one of the preceding aspects from the 45$^{th}$ to the 67$^{th}$ the film supplying station (1) engages one feed roll (2) providing the top closure film (3) of width (W), measured parallel to said unwinding axis (A), of at least 1000 mm.

In a 69$^{th}$ aspect according to any one of the preceding aspects from the 45$^{th}$ to the 68$^{th}$ the film supplying station (1) engages one feed roll (2) providing the top closure film (3) of width (W), measured parallel to said unwinding axis (A), of above 1200 mm.

In a 70$^{th}$ aspect according to any one of the preceding aspects from the 45$^{th}$ to the 69$^{th}$ the film supplying station (1) engages one feed roll (2) providing the top closure film (3) wherein the top closure film is a plastic film.

In a 71$^{st}$ aspect according to the preceding aspect wherein the top closure film has a thickness comprised between 10 and 200 μm.

In a 72$^{nd}$ aspect according to any one of the preceding aspects from the 62$^{nd}$ to the 71$^{st}$ the transfer device (10) comprises a transfer plate (40), optionally having a plurality of suction holes connected to a vacuum source, configured to move the separated unrolled portion or a/the plurality of distinct film sheets (5) from the cutting station (9) to the packaging station (30).

In a 73$^{rd}$ aspect according to any one of the preceding aspects from the 62$^{nd}$ to the 72$^{nd}$ the transfer device (10) comprises a transfer plate (40), having a plurality of suction holes connected to a vacuum source, configured to move the separated unrolled portion or a/the plurality of distinct film sheets (5) from the cutting station (9) to the packaging station (30).

In a 74$^{th}$ aspect according to any one of the preceding aspects from the 45$^{th}$ to the 73$^{rd}$ the transfer device (10) comprises one or more pincers acting on the leading edge (7*b*) of the selected unrolled portion from the cutting station (9) to the packaging station (30).

In a 75$^{th}$ aspect according to any one of the preceding aspects from the 45$^{th}$ to the 74$^{th}$ the apparatus (100) has no means for grasping opposite longitudinal side borders of said selected unrolled portion, in particular no conveying elements such as pincers grasping the longitudinal side borders of said selected unrolled portion are present and operate for transferring the unrolled selected portion (7) from the cutting station into the packaging station.

In a 76$^{th}$ aspect according to any one of aspects from the 1$^{st}$ to the 44$^{th}$ the packaging process uses the apparatus according to any one of aspects from the 45$^{th}$ to the 75$^{th}$.

In a 77$^{th}$ aspect according to any one of aspects from the 45$^{th}$ to the 75$^{th}$ the packaging apparatus (100) is configured to execute the packaging process according to any one of aspects from the 1$^{st}$ to the 44$^{th}$.

BRIEF DESCRIPTION OF THE DRAWINGS

Embodiments and aspects of the invention are described herein below, with reference to the accompanying drawings, which are provided for exemplifying and non-limitative purpose, in which:

FIG. 5 shows a support, in the form of tray with side wall and peripheral flange, which may be used in the process and with the apparatus of the invention; the tray is closed by a top closure film.

FIG. 6, is a schematic top view showing the lower tool of a packaging station hosting eight supports or trays positioned according to two rows of 4 trays each; FIG. 6 also schematically shows a conveyor carrying a selected unrolled portion of top closure film formed by eight adjacent sheets on the verge of being conveyed into the packaging station.

FIG. 7 is a schematic cross section of a portion of the tray of FIG. 5 with a top closure film heat sealed to the flange to form a controlled atmosphere or a natural atmosphere package; and FIG. 8 is a schematic cross section of a portion of the tray of FIG. 5 with a top closure film heat sealed to the flange to form a vacuum skin package.

CONVENTIONS

Figure 1:
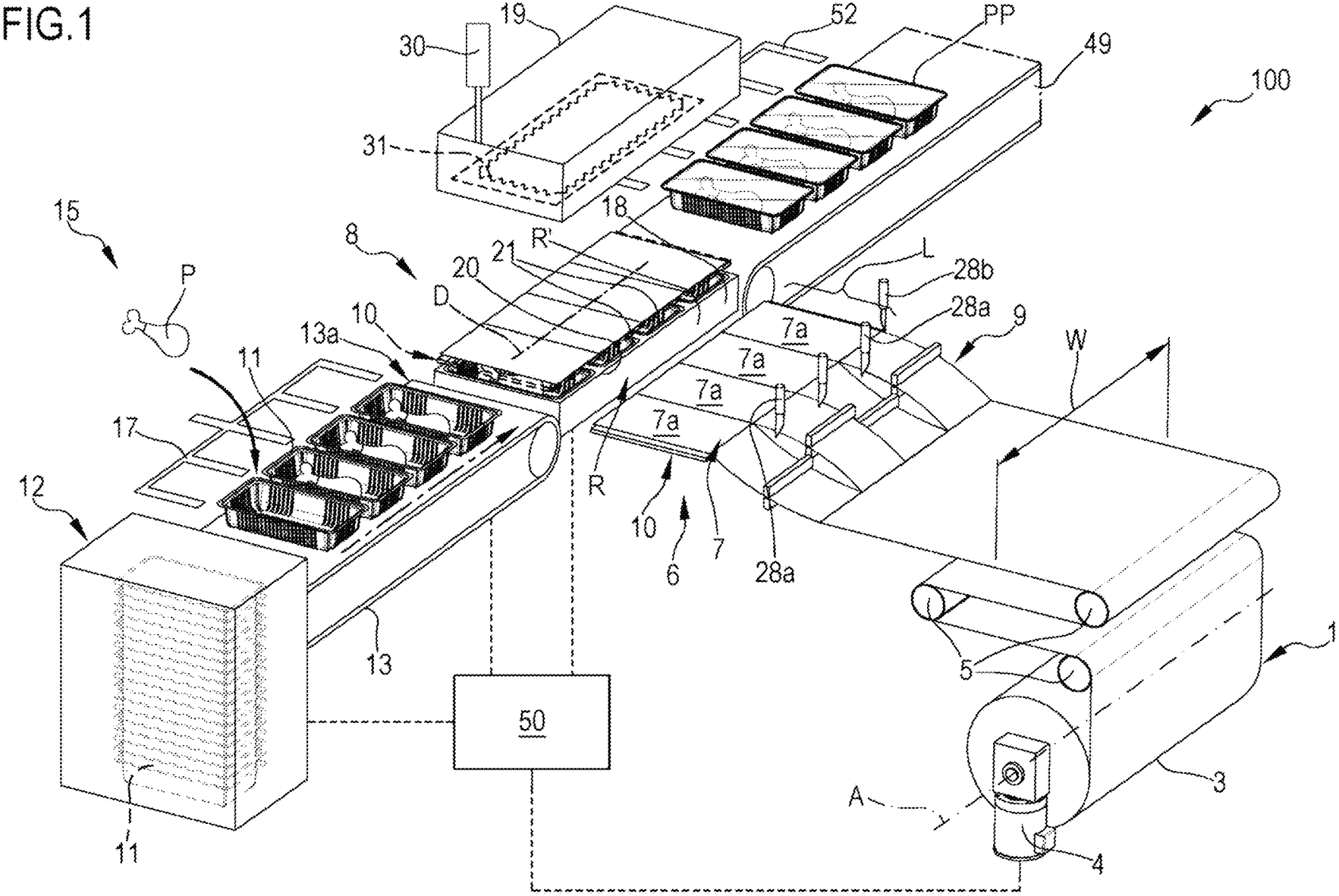
FIG. 1 is a schematic perspective view showing an apparatus executing a packaging process, according to aspects of the present invention.

It should be noted that in the present detailed description, corresponding parts illustrated in the various figures are indicated with the same reference numerals. The figures could illustrate the object of the invention by means of non-scale representations; therefore, parts and components shown in the figures relating to the object of the invention could only concern schematic representations.

The terms upstream and downstream refer to a direction of advancement of a package—or of a support for making said package—along a predetermined path defined starting from a starting or forming station of a support for said package, through a packaging station and then up to a packaging unloading station.

Definitions

Although certain aspects of the invention may find application for packaging a product into a packaging solely formed of one or more plastic films, the following description will mainly refer to packaging of a product positioned on a support to which a plastic film is heat sealed. Note the product may be a food product or not.

As used herein support means either a substantially flat element onto which a product is placed, or a container (alternatively referred to as tray) of the type having a base wall, a side wall and a top rim radially emerging from the side wall, the container defining a volume into which the product is positioned.

The trays or supports may have a rectangular shape or any other suitable shape, such as round, square, elliptical etcetera, and may be formed either while the packaging process takes place, e.g. at a thermoforming station of the packaging apparatus, or they may be manufactured beforehand and then fed to the packaging apparatus.

When used herein 'selected unrolled portion' refers to a portion of the top closure film which is unrolled from the top closure film feed roll and which extends across the full width of the top closure film. The selected unrolled portion presents same width (measured perpendicular to the direction of flow of the top closure film and thus parallel to the unwinding axis) of the top closure film and length smaller than its width. In general, the selected unrolled portion has the shape of a rectangular strip with the long side being the width and the short side being the length.

The Trays or Supports

The tray or support may be made of a single layer or, preferably, of a multi-layer polymeric material. In case of a single layer material suitable polymers are for instance polystyrene, polypropylene, polyesters, high density polyethylene, poly(lactic acid), PVC and the like, either foamed or solid.

In an option, the tray or support may provided with gas barrier properties. As used herein such term refers to a film or sheet of material which has an oxygen transmission rate of less than 200 cm3/m2-day-bar, less than 150 cm3/m2-day-bar, less than 100 cm3/m2-day-bar as measured according to ASTM D-3985 at 23° C. and 0% relative humidity.

Suitable materials for gas barrier monolayer thermoplastic trays are for instance polyesters, polyamides and the like.

In case the tray or support is made of a multi-layer material, suitable polymers are for instance ethylene homo- and co-polymers, propylene homo- and co-polymers, polyamides, polystyrene, polyesters, poly(lactic acid), PVC and the like. Part of the multi-layer material can be solid and part can be foamed.

For example, the tray or support may comprises at least one layer of a foamed polymeric material chosen from the group consisting of polystyrene, polypropylene, polyesters and the like.

The multi-layer material may be produced either by co-extrusion of all the layers using co-extrusion techniques or by glue- or heat-lamination of, for instance, a rigid foamed or solid substrate with a thin film, usually called "liner". The thin film may be laminated either on the side of the tray or support in contact with the product P or on the side facing away from the product P or on both sides. In the latter case the films laminated on the two sides of the tray may be the same or different. A layer of an oxygen barrier material, for instance (ethylene-co-vinyl alcohol) copolymer, is optionally present to increase the shelf-life of the packaged product P.

Gas barrier polymers that may be employed for the gas barrier layer are PVDC, EVOH, polyamides, polyesters and blends thereof. The thickness of the gas barrier layer will be set in order to provide the tray with an oxygen transmission rate suitable for the specific packaged product.

The tray or support may also comprise a heat sealable layer. Generally, the heat-sealable layer will be selected among the polyolefins, such as ethylene homo- or co-polymers, propylene homo- or co-polymers, ethylene/vinyl acetate copolymers, ionomers, and the homo- and co-polyesters, e.g. PETG, a glycol-modified polyethylene terephthalate.

Additional layers, such as adhesive layers, to better adhere the gas-barrier layer to the adjacent layers, may be present in the gas barrier material for the tray and are preferably present depending in particular on the specific resins used for the gas barrier layer.

In case of a multilayer material used to form the tray or support, part of this structure may be foamed and part may be un-foamed. For instance, the tray may comprise (from the outermost layer to the innermost food-contact layer) one or more structural layers, typically of a material such as foam polystyrene, foam polyester or foam polypropylene, or a cast sheet of e.g. polypropylene, polystyrene, poly(vinyl chloride), polyester or cardboard; a gas barrier layer and a heat-sealable layer.

The tray or supports may be obtained from a sheet of foamed polymeric material having a film comprising at least one oxygen barrier layer and at least one surface sealing layer laminated onto the side facing the packaged product, so that the surface sealing layer of the film is the food contact layer the tray. A second film, either barrier or non-barrier, may be laminated on the outer surface of the tray or support.

Specific formulations are used for food products which require heating in conventional or microwave oven before consumption. The surface of the container in contact with the product, i.e. the surface involved in the formation of the seal with the lidding film, may comprise a polyester resin. For instance the container can be made of a cardboard coated with a polyester or it can be integrally made of a polyester resin. Examples of suitable containers for the package of the invention are CPET, APET or APET/CPET containers. Such container can be either foamed or not-foamed.

The Film or Film Material Applied to Trays or Supports to Form a Package

Film or film material (also indicated as top film or top closure film) is applied to the tray/support to form a lid onto the tray/support (e.g., for MAP—modified atmosphere packaging) or a skin associated to the tray or support and matching the contour of the product.

The film for skin applications may be made of a flexible multi-layer material comprising at least a first outer heat-sealable layer, an optional gas barrier layer and a second outer heat-resistant layer. The outer heat-sealable layer may comprise a polymer capable of welding to the inner surface of the supports carrying the products to be packaged, such as for instance ethylene homo- or co-polymers, like LDPE, ethylene/alpha-olefin copolymers, ethylene/acrylic acid copolymers, ethylene/methacrylic acid copolymers, and ethylene/vinyl acetate copolymers, ionomers, co-polyesters, e.g. PETG. The optional gas barrier layer preferably comprises oxygen impermeable resins like PVDC, EVOH, polyamides and blends of EVOH and polyamides. The outer heat-resistant layer may be made of ethylene homo- or copolymers, ethylene/cyclic-olefin copolymers, such as ethylene/norbornene copolymers, propylene homo- or co-polymers, ionomers, (co)polyesters, (co)polyamides. The film may also comprise other layers such as adhesive layers or bulk layers to increase thickness of the film and improve its abuse and deep drawn properties. Particularly used bulk layers are ionomers, ethylene/vinyl acetate copolymers, polyamides and polyesters. In all the film layers, the polymer components may contain appropriate amounts of additives normally included in such compositions. Some of these additives are preferably included in the outer layers or in one of the outer layers, while some others are preferably added to inner layers. These additives include slip and anti-block agents such as talc, waxes, silica, and the like, antioxidants, stabilizers, plasticizers, fillers, pigments and dyes, cross-linking inhibitors, cross-linking enhancers, UV absorbers, odor absorbers, oxygen scavengers, bactericides, antistatic agents and the like additives known to those skilled in the art of packaging films.

One or more layers of the film can be cross-linked to improve the strength of the film and/or its heat resistance. Cross-linking may be achieved by using chemical additives or by subjecting the film layers to an energetic radiation treatment. The films for skin packaging are typically manufactured in order to show low shrink when heated during the packaging cycle. Those films usually shrink less than 15% at 160° C., more frequently lower than 10%, even more frequently lower than 8% in both the longitudinal and transversal direction (ASTM D2732). The films usually have a thickness comprised between 20 microns and 200 microns, more frequently between 40 and 180 microns and even more frequently between 50 microns and 150 microns.

On the other hand, in case the film is used for creating a lid on the tray/support, the film material may be obtained by co-extrusion or lamination processes. Lid films may have a symmetrical or asymmetrical structure and can be monolayer or multilayer. The multilayer films have at least 2, more frequently at least 5, even more frequently at least 7 layers. The total thickness of the film may vary frequently from 3 to 100 micron, in particular from 5 to 50 micron, even more frequently from 10 to 30 micron. The films may be optionally cross-linked. Cross-linking may be carried out by irradiation with high energy electrons at a suitable dosage level as known in the art. The lid films described above may be heat shrinkable or heat-set. The heat shrinkable films typically show free shrink value at 120° C. measured according to ASTM D2732 in the range of from 2 to 80%, more frequently from 5 to 60%, even more frequently from 10 to 40% in both the longitudinal and transverse direction. The heat-set films usually have free shrink values lower than 10% at 120° C., preferably lower than 5% in both the longitudinal and transversal direction (ASTM D 2732). Lid films usually comprise at least a heat sealable layer and an outer skin layer, which is generally made up of heat resistant polymers or polyolefin. The sealing layer typically comprises a heat-sealable polyolefin which in turn comprises a single polyolefin or a blend of two or more polyolefins such as polyethylene or polypropylene or a blend thereof. The sealing layer can be further provided with antifog properties by incorporating one or more antifog additives into its composition or by coating or spraying one or more antifog additives onto the surface of the sealing layer by technical means well known in the art. The sealing layer may further comprise one or more plasticisers. The skin layer may comprises polyesters, polyamides or polyolefin. In some structures, a blend of polyamide and polyester can advantageously be used for the skin layer. In some cases, the lid films comprise a barrier layer. Barrier films typically have an OTR (evaluated at 23° C. and 0% according to ASTM D-3985) below 100 cm3/(m2·day·atm) and more frequently below 80 cm3/(m2·day·atm). The barrier layer is usually made of a thermoplastic resin selected among a saponified or hydrolyzed product of ethylene-vinyl acetate copolymer (EVOH), an amorphous polyamide and a vinyl-vinylidene chloride and their admixtures. Some materials comprise an EVOH barrier layer, sandwiched between two polyamide layers. The skin layer typically comprises polyesters, polyamides or polyolefin.

In some packaging applications, the lid films do not comprise any barrier layer. Such films usually comprise one or more polyolefin are herein defined.

Non-barrier films typically have an OTR (evaluated at 23° C. and 0% R.H. according to ASTM D-3985) from 100 cm3/(m2·day·atm) up to 10000 cm3/(m2·day·atm), more typically up to 6000 cm3/(m2·day·atm).

Peculiar compositions polyester-based are those used for tray lidding of ready-meals packages. For these films, the polyester resins can make up at least 50%, 60%, 70%, 80%, 90% by weight of the film. These films are typically used in combination with polyester-based supports.

For instance the container can be made of a cardboard coated with a polyester or it can be integrally made of a polyester resin. Examples of suitable containers for the package are CPET, APET or APET/CPET containers, either foamed or not-foamed.

Usually, biaxially oriented PET are used as the lid film due to its high thermal stability at standard food heating/cooking temperatures. Often biaxially oriented polyester films are heat-set, i.e. non-heat-shrinkable. To improve the heat-sealability of the PET lidding film to the container a heat-sealable layer of a lower melting material is usually provided on the film. The heat-sealable layer may be coextruded with the PET base layer (as disclosed in EP-A-1,529,797 and WO2007/093495) or it may be solvent- or extrusion-coated over the base film (as disclosed in U.S. Pat. No. 2,762,720 and EP-A-1,252,008).

Particularly in the case of fresh red meat packages, twin lidding film comprising an inner, oxygen-permeable, and an outer, oxygen-impermeable, lidding film are advantageously used. The combination of these two films significantly prevents the meat discoloration also when the packaged meat extends upwardly with respect to the height of the tray walls, which is the most critical situation in barrier packaging of fresh meat.

These films are described for example in EP1848635 and EP0690012, the disclosures of which are herein incorporated by reference.

The lid film can be monolayer. Typical composition of monolayer films comprise polyesters as herein defined and their blends or polyolefins as herein defined and their blends.

In all the film layers herein described, the polymer components may contain appropriate amounts of additives normally included in such compositions. Some of these additives are preferably included in the outer layers or in one of the outer layers, while some others are preferably added to inner layers. These additives include slip and anti-block agents such as talc, waxes, silica, and the like, antioxidants, stabilizers, plasticizers, fillers, pigments and dyes, cross-linking inhibitors, cross-linking enhancers, UV absorbers, odor absorbers, oxygen scavengers, bactericides, antistatic agents, anti-fog agents or compositions, and the like additives known to those skilled in the art of packaging films.

The films suitable for lidding application can advantageously be perforated, in order to allow the packaged food to breath.

Those films may be perforated by using different technologies available in the art, through laser or mechanical means such as rolls provided with several needles.

The number of perforations per unit area of the film and their dimensions affect the gas permeability of the film.

Microperforated films are usually characterized by OTR value (evaluated at 23° C. and 0% R.H. according to ASTM D-3985) from 2500 cm3/(m2·day·atm) up to 1000000 cm3/(m2·day·atm).

Macroperforated films are usually characterized by OTR (evaluated at 23° C. and 0% R.H. according to ASTM D-3985) higher than 1000000 cm3/(m2·day·atm).

Furthermore, the films herein described for lidding applications can be formulated to provide strong or peelable sealing onto the support. A method of measuring the force of a peelable seal, herein referred to as "peel force" is described in ASTM F-88-00. Acceptable peel force values fare in the range from 100 g/25 mm to 850 g/25 mm, from 150 g/25 mm to 800 g/25 mm, from 200 g/25 mm to 700 g/25 mm.

The desired seal strength is achieved specifically designing the tray and the lid formulations.

In general, one or more layers of the lid film can be printed, in order to provide useful information to the consumer, a pleasing image and/or trademark or other advertising information to enhance the retail sale of the packaged product.

The film may be printed by any suitable method, such as rotary screen, gravure or flexographic techniques mas known in the art.

Definitions and Conventions Concerning Materials

PVDC is any vinylidene chloride copolymers wherein a major amount of the copolymer comprises vinylidene chloride and a minor amount of the copolymer comprises one or more unsaturated monomers copolymerisable therewith, typically vinyl chloride, and alkyl acrylates or methacrylates (e.g. methyl acrylate or methacrylate) and the blends thereof in different proportions. Generally a PVDC barrier layer will contain plasticisers and/or stabilizers as known in the art.

As used herein, the term EVOH includes saponified or hydrolyzed ethylene-vinyl acetate copolymers, and refers to ethylene/vinyl alcohol copolymers having an ethylene comonomer content preferably comprised from about 28 to about 48 mole %, more preferably, from about 32 to about 44 mole % ethylene, and even more preferably, and a saponification degree of at least 85%, preferably at least 90%.

The term "polyamides" as used herein is intended to refer to both homo- and co- or ter-polyamides. This term specifically includes aliphatic polyamides or co-polyamides, e.g., polyamide 6, polyamide 11, polyamide 12, polyamide 66, polyamide 69, polyamide 610, polyamide 612, copolyamide 6/9, copolyamide 6/10, copolyamide 6/12, copolyamide 6/66, copolyamide 6/69, aromatic and partially aromatic polyamides or co-polyamides, such as polyamide 61, polyamide 6I/6T, polyamide MXD6, polyamide MXD6/MXDI, and blends thereof.

As used herein, the term "copolymer" refers to a polymer derived from two or more types of monomers, and includes terpolymers. Ethylene homopolymers include high density polyethylene (HDPE) and low density polyethylene (LDPE). Ethylene copolymers include ethylene/alpha-olefin copolymers and ethylene/unsaturated ester copolymers. Ethylene/alpha-olefin copolymers generally include copolymers of ethylene and one or more comonomers selected from alpha-olefins having from 3 to 20 carbon atoms, such as 1-butene, 1-pentene, 1-hexene, 1-octene, 4-methyl-1-pentene and the like.

Ethylene/alpha-olefin copolymers generally have a density in the range of from about 0.86 to about 0.94 g/cm$^3$. The term linear low density polyethylene (LLDPE) is generally understood to include that group of ethylene/alpha-olefin copolymers which fall into the density range of about 0.915 to about 0.94 g/cm$^3$ and particularly about 0.915 to about 0.925 g/cm$^3$. Sometimes linear polyethylene in the density range from about 0.926 to about 0.94 g/cm$^3$ is referred to as linear medium density polyethylene (LMDPE). Lower density ethylene/alpha-olefin copolymers may be referred to as very low density polyethylene (VLDPE) and ultra-low density polyethylene (ULDPE). Ethylene/alpha-olefin copolymers may be obtained by either heterogeneous or homogeneous polymerization processes.

Another useful ethylene copolymer is an ethylene/unsaturated ester copolymer, which is the copolymer of ethylene and one or more unsaturated ester monomers. Useful unsaturated esters include vinyl esters of aliphatic carboxylic acids, where the esters have from 4 to 12 carbon atoms, such as vinyl acetate, and alkyl esters of acrylic or methacrylic acid, where the esters have from 4 to 12 carbon atoms.

Ionomers are copolymers of an ethylene and an unsaturated monocarboxylic acid having the carboxylic acid neutralized by a metal ion, such as zinc or, preferably, sodium.

Useful propylene copolymers include propylene/ethylene copolymers, which are copolymers of propylene and ethylene having a majority weight percent content of propylene, and propylene/ethylene/butene terpolymers, which are copolymers of propylene, ethylene and 1-butene.

As used herein, the term "polyolefin" refers to any polymerized olefin, which can be linear, branched, cyclic, aliphatic, aromatic, substituted, or unsubstituted. More specifically, included in the term polyolefin are homo-polymers of olefin, co-polymers of olefin, co-polymers of an olefin and an non-olefinic co-monomer co-polymerizable with the olefin, such as vinyl monomers, modified polymers thereof, and the like. Specific examples include polyethylene homo-polymer, polypropylene homo-polymer, polybutene homo-polymer, ethylene-alpha-olefin co-polymer, propylene-alpha-olefin co-polymer, butene-alpha-olefin co-polymer, ethylene-unsaturated ester co-polymer, ethylene-unsaturated acid co-polymer, (e.g. ethylene-ethyl acrylate co-polymer, ethylene-butyl acrylate co-polymer, ethylene-methyl acrylate co-polymer, ethylene-acrylic acid co-polymer, and ethylene-methacrylic acid co-polymer), ethylene-vinyl acetate copolymer, ionomer resin, polymethylpentene, etc.

The term "polyester" is used herein to refer to both homo- and co-polyesters, wherein homo-polyesters are defined as polymers obtained from the condensation of one dicarboxylic acid with one diol and co-polyesters are defined as polymers obtained from the condensation of one or more dicarboxylic acids with one or more diols. Suitable polyester resins are, for instance, polyesters of ethylene glycol and terephthalic acid, i.e. poly(ethylene terephthalate) (PET). Preference is given to polyesters which contain ethylene units and include, based on the dicarboxylate units, at least 90 mol %, more preferably at least 95 mol %, of terephthalate units. The remaining monomer units are selected from other dicarboxylic acids or diols. Suitable other aromatic dicarboxylic acids are preferably isophthalic acid, phthalic acid, 2,5-, 2,6- or 2,7-naphthalenedicarboxylic acid. Of the cycloaliphatic dicarboxylic acids, mention should be made of cyclohexanedicarboxylic acids (in particular cyclohexane-1,4-dicarboxylic acid). Of the aliphatic dicarboxylic acids, the (C3-Ci9)alkanedioic acids are particularly suitable, in particular succinic acid, sebacic acid, adipic acid, azelaic acid, suberic acid or pimelic acid. Suitable diols are, for example aliphatic diols such as ethylene glycol, diethylene glycol, triethylene glycol, propylene glycol, 1,3-butane diol, 1,4-butane diol, 1,5-pentane diol, 2,2-dimethyl-1,3-propane diol, neopentyl glycol and 1,6-hexane diol, and cycloaliphatic diols such as 1,4-cyclohexanedimethanol and 1,4-cyclohexane diol, optionally heteroatom-containing diols having one or more rings.

Co-polyester resins derived from one or more dicarboxylic acid(s) or their lower alkyl (up to 14 carbon atoms) diesters with one or more glycol(s), particularly an aliphatic or cycloaliphatic glycol may also be used as the polyester resins for the base film.

Suitable dicarboxylic acids include aromatic dicarboxylic acids such as terephthalic acid, isophthalic acid, phthalic acid, or 2,5-, 2,6- or 2,7-naphthalenedicarboxylic acid, and aliphatic dicarboxylic acids such as succinic acid, sebacic acid, adipic acid, azelaic acid, suberic acid or pimelic acid. Suitable glycol(s) include aliphatic diols such as ethylene glycol, diethylene glycol, triethylene glycol, propylene glycol, 1,3-butane diol, 1,4-butane diol, 1,5-pentane diol, 2,2-dimethyl-1,3-propane diol, neopentyl glycol and 1,6-hexane diol, and cycloaliphatic diols such as 1,4-cyclohexanedimethanol and 1,4-cyclohexane diol. Examples of such copolyesters are (i) copolyesters of azelaic acid and terephthalic acid with an aliphatic glycol, preferably ethylene glycol; (ii) copolyesters of adipic acid and terephthalic acid with an aliphatic glycol, preferably ethylene glycol; and (iii) copolyesters of sebacic acid and terephthalic acid with an aliphatic glycol, preferably butylene glycol; (iv) co-polyesters of ethylene glycol, terephthalic acid and isophthalic acid. Suitable amorphous co-polyesters are those derived from an aliphatic diol and a cycloaliphatic diol with one or more, dicarboxylic acid(s), preferably an aromatic dicarboxylic acid. Typical amorphous copolyesters include co-polyesters of terephthalic acid with an aliphatic diol and a cycloaliphatic diol, especially ethylene glycol and 1,4-cyclohexanedimethanol.

Product

The term product P refers to an article or a composite of articles of any kind. For example, the product may be of a foodstuff type and be in the solid, liquid or gel state, i.e. in the form of two or more of the aforementioned aggregation states.

In the food sector, the product can include: meat, fish, cheese, treated meats, prepared and frozen meals of various kinds.

Control Unit

The packaging apparatus described and claimed herein may include one or more control units, designed to control the operations performed by the apparatus. The control unit can evidently be only one or be formed by a plurality of distinct control units according to the design choices and operational needs.

The term control unit means an electronic component which can comprise at least one of: a digital processor (for example comprising at least one selected in the group between: CPU, GPU, GPGPU), a memory (or memories), an analog circuit, or a combination of one or more digital processing units with one or more analog circuits. The control unit can be "configured" or "programmed" to perform some steps: this may be done in practice by any means that allows you to configure or program the control unit. For example, in the case of a control unit comprising one or more CPUs and one or more memories, one or more programs can be stored in appropriate memory banks connected to the CPU or to the CPUs; the program or programs contain instructions which, when executed by the CPU or the CPUs, program or configure the control unit to perform the operations described in relation to the control unit. Alternatively, if the control unit is or includes analog circuitry, then the control unit circuit may be designed to include configured circuitry in use to process electrical signals so as to perform the steps related to control unit. The control unit may comprise one or more digital units, for example of the microprocessor type, or one or more analog units, or a suitable combination of digital and analog units; the control unit can be configured to coordinate all the actions necessary for executing an instruction and instruction sets.

Actuator

The term actuator means any device capable of causing movement on a body, for example behind the control unit (reception by the actuator of a command sent by the control unit). The actuator can be of an electric, pneumatic, mechanical (for example with a spring) type, or of another type.

Detailed Description

With reference to the attached figures it is described a packaging apparatus 100, which comprises a film supplying station 1 presenting a feed roll 2 configured to turn around a respective unwinding axis A to unroll consecutive portions of a top closure film 3.

In accordance with an aspect, the width W of the top closure film 3, measured parallel to the unwinding axis A is at least 450 mm, optionally at least 600 mm, more optionally at least 1000 mm, even more optionally above 1200 mm.

In term of materials, the top closure film is a plastic film, in particular an extruded mono or multilayer plastic film as disclosed in the above dedicated section and may have a thickness comprised between 10 and 200 μm.

According to a preferred configuration, the axis of rotation A of the feed roll 2 is arranged horizontally, in particular parallel to the ground. The supplying station 1 may have an electric motor 4 connected to the feed roll 2 and configured to put into rotation the feed roll 2 around the unwinding axis A, in order to unroll, in a controlled manner, subsequent portions of plastic film 3. The electric motor 4 may be connected to the feed roll 2 through a gear train, in order to reduce the angular speed of the motor 4 and increase the applied torque. Of course, it is not excluded that the feed roll 2 may also not be motorized, and for example either be free to rotate or be braked, for example under the action of a friction brake. The top closure film 3 is progressively unrolled and preferably moved about a number of rollers 5 having the task to impose a prescribed path to the film 3 and to maintain a proper film tension. The unrolled portions of top closure film are driven, e.g. via conventional means such as motorized rollers or pincers, to a film pick up zone 6 where, at each packaging cycle, a selected unrolled portion 7 of the top closure film 3 is picked up and transferred inside a packaging station 8 of the apparatus 100. At the pick-up zone 6, in accordance with certain embodiments for example shown in FIGS. 1, 2 and 6, a cutting station 9 may operate. In other words, the unrolled portions of closure film 3 are either intercepted by the cutting station 9 located downstream the film supplying station 1 or are directly fed to the packaging station 8, as it will be further described in detail herein below.

Figure 2:
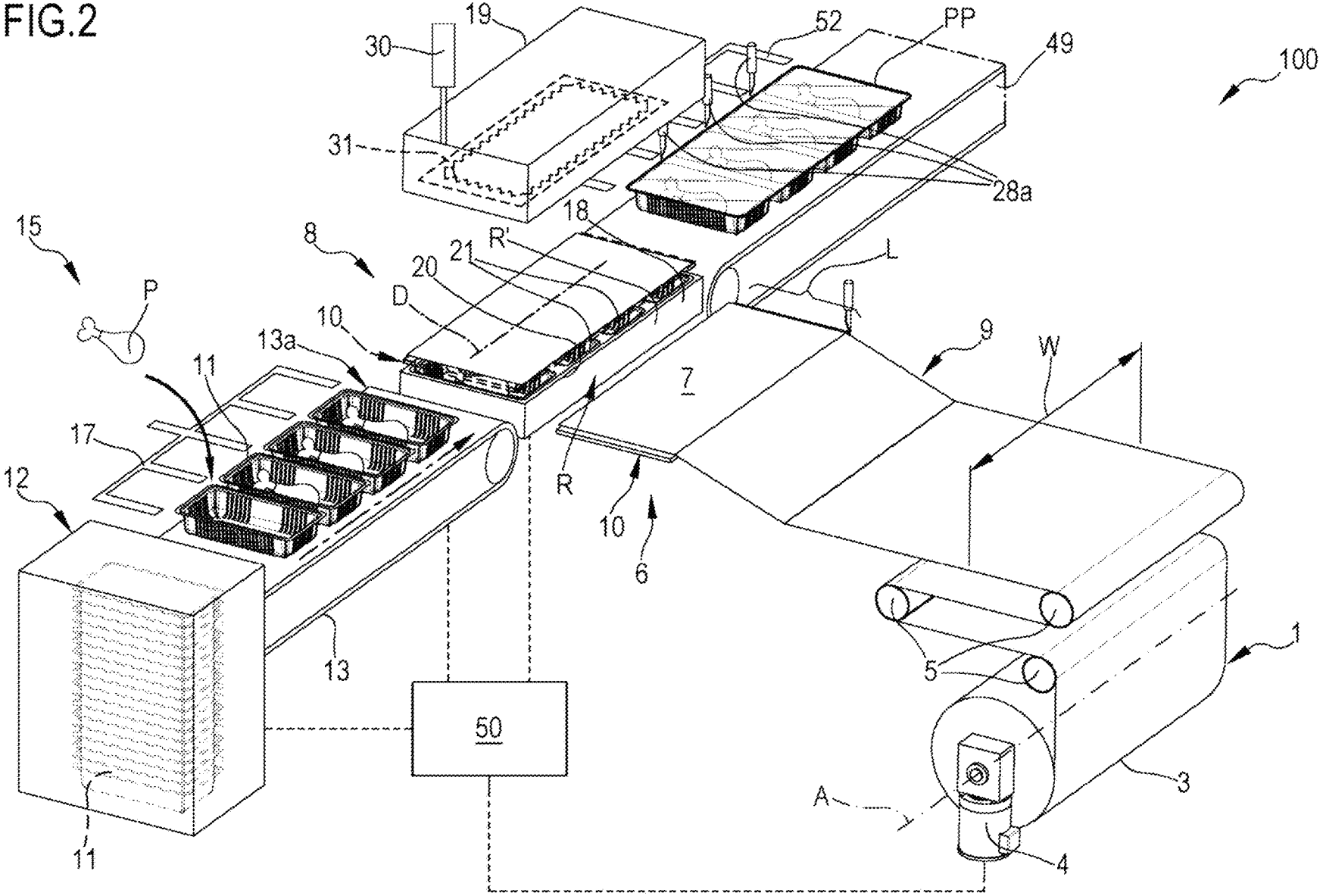
FIGS. 2 and 3 are perspective views of variants of an apparatus according to the invention.
Figure 3:
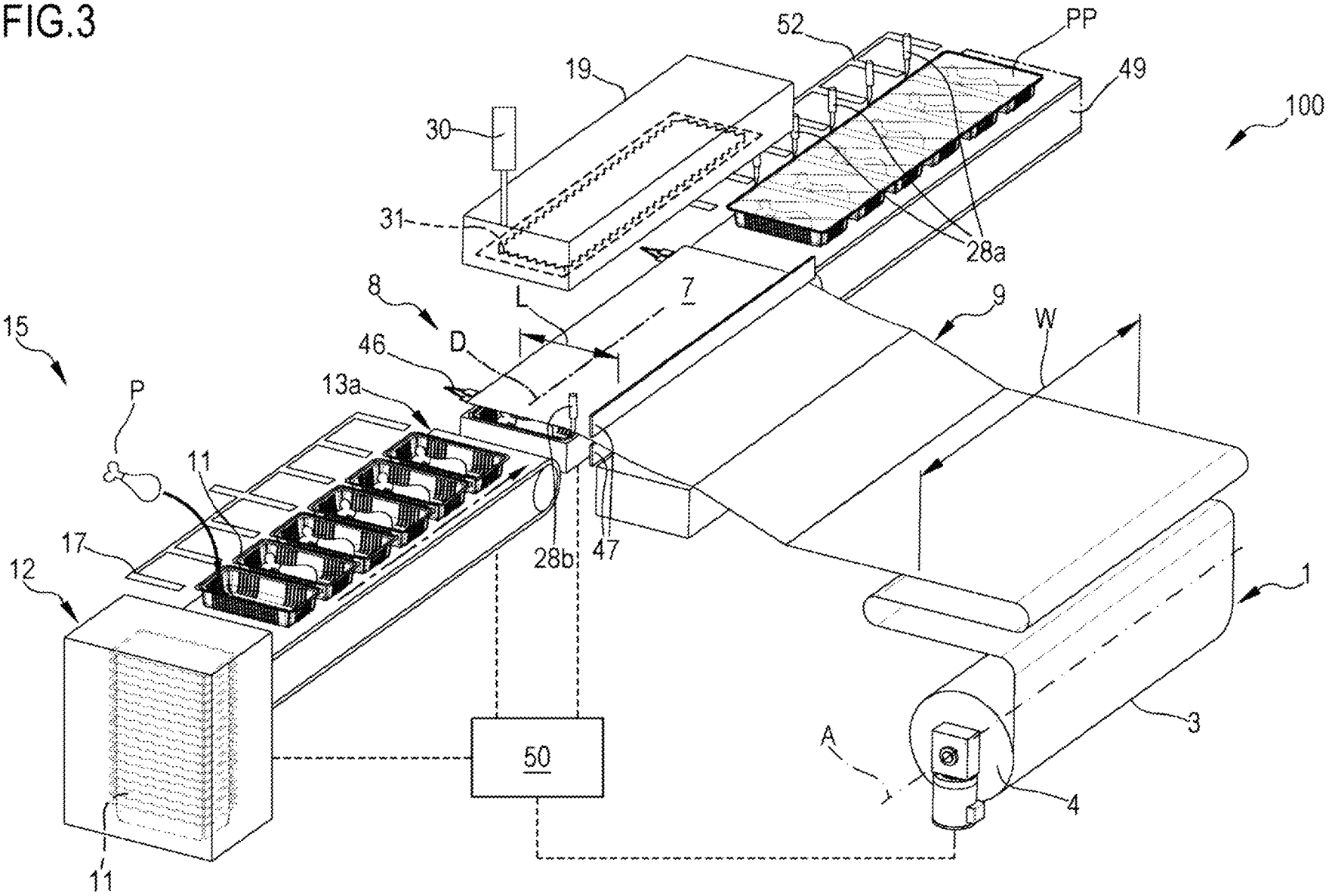

In general, the apparatus comprises a transfer device 10 (including one single transport device or a plurality of cooperating transport devices), which is responsible for picking a selected unrolled portion of the top closure film either from the cutting station (see examples of FIGS. 1 and 2) or directly from the pick-up zone 6 where the selected unrolled portion 7 arrives (see for example FIG. 3). The transfer device 10 acts on the selected unrolled portion 7 of the top closure film and brings it inside the packaging station 8. As it is visible from the attached drawings, each of selected unrolled portion 7 has the same width W, measured parallel to the unwinding axis A, of the top closure film 3. In other words, each selected unrolled portion 7 is preferably a rectangular strip extending across the full width of the top closure film 3, which is therefore transported by the transfer device 10 inside the packaging station 8, in order to then close a plurality of product loaded supports 11 positioned inside the same packaging station.

Figure 4:
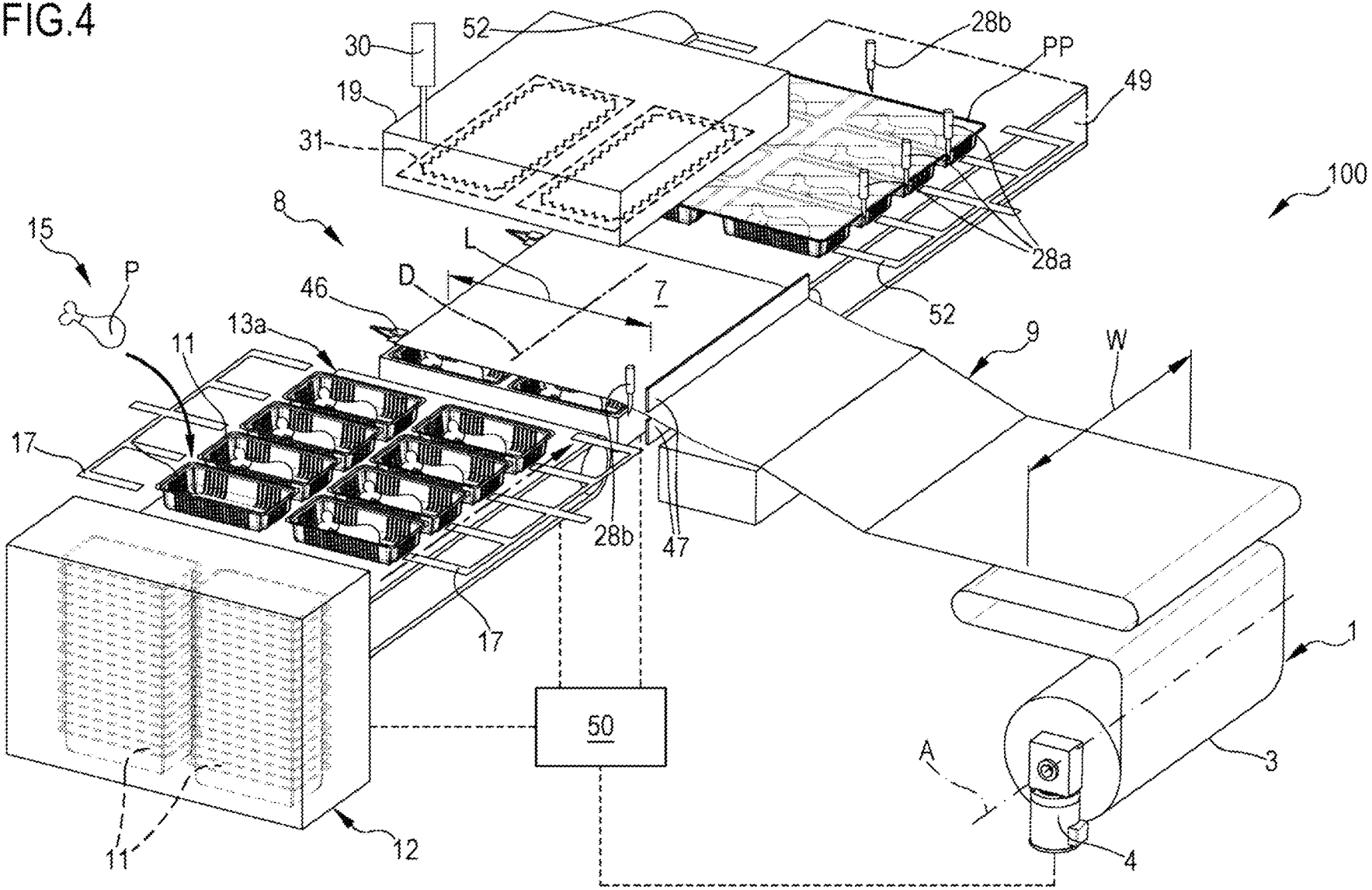
FIG. 4 is a perspective view of an alternative apparatus of the invention.

In this connection, the apparatus 100 comprises a support feed station 12 where empty supports 11 are loaded on a first conveyor 13, for example a conveyor belt onto which the supports 11 may be located or a conveyor provided with a sliding surface receiving the supports and cross pieces pushing the supports, or a conveyor having a top side provide with appropriately shaped seats for receiving the supports, or a conveyor of yet another nature. The support feed station 12 may include a support dispenser automatically depositing supports in the appropriate location of the first conveyor or it may simply comprise one or more posts where operators manually load the supports 11. Downstream the support feed station 12, a product loading station 15 operates where either one or more operators provide for loading of the products P in the respective supports 11 positioned on the first conveyor or where one or more automated product dispensing devices deliver one or more products or product dosages P into or above each one of the supports travelling on the first conveyor 13. The first conveyor 13 may be designed to transport the product loaded supports 11 inside the packaging station 8 or, alternatively, an appropriate transfer mechanism 17 operates between the downstream end 13*a* of the first conveyor 13 and the packaging station 8, in order to pick from the first conveyor 13 one or more arriving product loaded supports 11 and move them in an appropriate location inside the packaging station 8 where the product loaded supports will receive the top closure film 3 and form closed packages. The transfer mechanism 17 may for example include two side bars operative on opposite sides of a row of supports. The opposite bar may present shaped cavities facing the supports to receive the sides of the supports: the bars may be actuated back and forth from the downstream end of the conveyor to inside of the packaging station and vice-versa in order to properly load this the packaging station with an adequate number of supports at each packaging cycle. Alternatively, the transfer mechanism may include robotized arms which pick the supports and displace them in the appropriate location inside the packaging station. Other transfer systems may however be envisaged without departing from the scope of the present disclosure. As shown in the drawings, the packaging station 8 comprises a lower tool 18 and an upper tool 19 cooperating with the lower tool: the supports 11 are positioned at a lower tool loading area 20 which is designed to receive the supports 11 served either by the first conveyor 13 of by the transfer mechanism 17. In accordance with one aspect, the supports 11 are positioned in the lower tool loading area 20 according to one or more parallel rows of supports (each row of supports is indicated with R in the attached drawings): each row R of supports includes a plurality of supports aligned along a predetermined alignment direction D, while the number of aligned supports 11 in each row R of supports is greater than the number of rows R of supports in the lower tool loading area 20. For example the lower tool loading area 20 may be designed to receive one row of 3 supports, or one row with 4 or more supports (see FIGS. 1-3) or two rows each having 3 or more supports (see FIG. 4). In one possible example, the product loaded supports 11 are positioned at the lower tool loading area in correspondence of one or more rows R' of seats 21; the rows R' of seats 21 are aligned along the alignment direction D: each row R of seats comprises 3 or more seats thus defining a respective row R of supports having 3 or more supports. For example each row R' of seats may comprise 5 or more seats thus forming a respective row R of supports having 5 or more supports. It is to be noted that in accordance with one aspect the lower tool loading area 20 may be extremely elongated in the alignment direction D and thus include one or two (more rarely three or more) rows R' of seats (and thus rows R of supports) including up to 7, 8 or more aligned seats 21 or supports 11. The number of seats 21 on each row of seats may be at least twice the number of rows R' of seats present in the lower tool loading area. Thus, the number of supports in each row of supports may correspondingly be at least twice the number of rows. This, as it will be further explained, does not compromise the ability of the apparatus and process of the invention to perfectly position the top closure film 3 and seal all the supports 11 in the packaging station 8, due to the peculiar way of the invention to feed the top closure film to the packaging station.

Again with reference to the drawings, and as already mentioned, the lower tool loading area 20 has a plurality of parallel rows R' of seats 21 aligned along the alignment direction D: each one of the supports 11 is positioned in one respective seat 21 thus forming rows of aligned supports; the seats 21 may for example be dedicated areas on the top side of the lower tool, or indents in the top side of the lower tool counter-shaped to the support perimeter of the support each seat needs to receive. The top closure film is unrolled from the feed roll 2 and moved to the pick-up zone 6 where the selected unrolled portion 7 arrives and is taken by the transfer device 10, which acts on the selected unrolled portion 7 of the top closure film and brings it inside the packaging station 8. Basically, at each packaging cycle, each selected unrolled portion 7 is therefore transported by the transfer device 10 inside the packaging station 8 in order to then close a plurality of product loaded supports positioned inside the same packaging station. The selected unrolled portion 7 of the top closure film is transferred inside the packaging station 8 and positioned above the lower tool loading area 20, with the width W of each unrolled portion aligned to the alignment direction D of the rows R and R' (respectively of supports and seats) in the lower tool loading area 20.

In practice, the selected the selected unrolled portion 7 of the top closure film transferred inside the packaging station 8 and above the lower tool loading area 20 is a plastic strip of rectangular shape and has width W sufficient to cover the extension along the alignment direction D of all supports 11 present in the packaging station: said in other words the selected unrolled portion 7 is a widthwise extending strip of the top closure film 3 which is longer in width than in length and which is moved onto the one or more rows of supports 11 with its width W aligned with the direction of alignment D of the row(s) of supports/seats.

The length L of each selected unrolled portion 7 transported inside the packaging station 8 (note the length L is measured perpendicular to the width W of the same selected unrolled portion) is sufficient to cover the extension, perpendicular to said alignment direction D of the lower tool loading area 20 and thus of all supports present in the packaging station. In the embodiments shown it is also to be noted that the film supplying station 1 engages in rotation the feed roll 2 about the respective unwinding axis A which is parallel to the predetermined alignment direction D.

In an embodiment, each one of the supports 11 may be in the form of a tray (see FIGS. 5, 7, 8) having a base wall 22, a side wall 23 emerging from the base wall 22 and a top flange 24 delimiting a top aperture 24' of the tray and emerging radially from the side wall (see FIG. 5). For example, the flange 24 may have a rectangular external perimeter 25 with two opposite first sides 25*a* and two opposite second sides 25*b* meeting the first sides at corner regions 26 of the flange: in the case of FIG. 6, the supports (in the form of trays) are positioned in the packaging station 8 with the two opposite first sides 25*a* directed parallel to the alignment direction D and with the two opposite second sides 25*b* directed perpendicular to the alignment direction D, as shown in FIGS. 1-4 and 6. The width W of the selected unrolled portion 7 transferred inside the packaging station 8 and above the supports 11 is at least equal to the measure of one first side 25*a* (of the flange external perimeter 25) multiplied by the number of supports 11 present in each row R, so as to cover the extension of the flanges 25 (in direction D) of all the supports or trays positioned in the lower tool loading area 20 (see e.g. FIG. 6). The length L of the selected unrolled portion 7 (which, as already mentioned, is shorter than the width) transferred inside the packaging station 8 and above the supports 11 is at least equal to the measure of one second side 25*b* (of the flange external perimeter 25) multiplied the number of rows R of supports 11 present in the packaging station, so as to cover the extension of the flanges in the direction perpendicular to D.

Although the attached figures show supports 11 in the form of trays with lateral wall and flange, the supports 11 may alternatively be flat. In case of flat supports, each support 11 may have (analogously to the external perimeter of the flange described above) a rectangular external perimeter with two opposite first sides and two opposite second sides meeting the first sides at corner regions of the flat support: in this case, the supports are positioned in the packaging station with the two opposite first sides directed parallel to the alignment direction D and with the two opposite second sides directed perpendicular to the alignment direction D. The width W of the selected unrolled portion transferred inside the packaging station and above the supports is at least equal to the measure of one first side (of the support external perimeter) multiplied by the number of supports present in each row, so as to cover the extension of the supports positioned in the lower tool loading area (see e.g. FIG. 6). The length L of the selected unrolled portion (which, as mentioned, is shorter than the width) transferred inside the packaging station and above the supports is at least equal to the measure of one second side (of the supports external perimeter) multiplied the number of rows of supports present in the packaging station.

An aspect of the invention provides that the selected unrolled portion 7 of the top closure film 3 transferred inside the packaging station and above the lower tool loading area 20 is a transversal, full-width, elongated strip of the top closure film. In particular, the selected unrolled portion 7 of the top closure film 3 transferred inside the packaging station 8 has width W significantly greater than the respective length L (measured perpendicular to said width W). For example, the width W of each selected unrolled portion of the top closure film transferred inside the packaging station may be at least twice or 3 times, or at least 5 times, or at least 10 times the respective length L. In practice, using relatively large width feed rolls 2 and thus relatively large width top closure films 3, it is possible with the width W of each selected portion 7 to cover the longitudinal extension (along direction D) of the whole lower tool loading area 20 (or the extension of row(s) of supports), thus being able at each packaging cycle to use a relatively short length of top closure film thereby solving in a simple manner all the drawbacks of the prior art.

Going in further detail, the apparatus and process according to aspect of the invention provide for repeating at intervals a packaging cycle comprising at least the following steps. The apparatus has in this regard a control unit 50 configured to execute the packaging cycle and at this purpose connected with the packaging station 8, the transfer device 10, and the other components described above. The packaging cycle comprises configuring the packaging station 8 in an open configuration, where the upper and lower tools 18 and 19 are spaced apart the one from the other, and with the packaging station in the open configuration positioning the supports 11, with at least a product loaded thereon, in the packaging station. Again with the packaging station in the open configuration the unrolled portion 7 is transferred into the packaging station 8 and above the lower tool loading area 20.

As discussed above, these steps may be executed under the control of the control unit 50 which may appropriately coordinate one or more actuators 30 acting on the packaging station to bring it in the open configuration, the first conveyor 13 and/or the transfer mechanism 17 to move the product loaded supports 11 in position in the lower tool loading area 20, and the above described transfer device 10 to move the selected unrolled portion 7 in the desired position above the product loaded supports.

Then, the packaging cycle provides for configuring the packaging station 8 in a closed configuration, wherein the upper and lower tools 18 and 19 are approached to each other. With the packaging station in the closed configuration, the top closure film 3 is fixed to the supports, in the selected unrolled portion 7 of the top closure film is heat sealed to the supports 11. As discussed above, these step may be executed under the control of the control unit 50, which may appropriately command a heater 31 present inside the packaging station (typically on the upper tool) to heat at least a peripheral band of the selected unrolled portion and to bring it against the underlying supports 11 in order to achieve heat sealing between the two.

In accordance with one possible variant of the invention, the apparatus and process may provide for a cutting procedure (see for example FIGS. 1, 2 and 6) executed at the cutting station 9 operatively interposed between the film supplying station 1 and the transfer device 10. In practice, before the selected unrolled portion is transferred inside the packaging station, the cutting station 9 receives the top closure film 3 and separates from it the selected unrolled portion 7 before it is transferred in the packaging station.

The cutting station 9, which is also connected and governed by the control unit 50 in coordination with the other parts of the apparatus described above, may transversally separate the selected unrolled portion 7 from the top closure film forming a single unitary separated unrolled portion, which is divided from the rest of the closure film 3 extending upstream the separated unrolled portion and coming from the feed roll 2. The separated unrolled portion 7 is in the form of a unitary strip having the same width W of the top closure film and a length L sensibly smaller than its width W. Alternatively, the cutting station 9 may be configured to both transversally separate said selected unrolled portion 7 from the top closure film and to also longitudinally divide the closure film 3 in correspondence of the same selected unrolled portion 7. In this way the separated unrolled portion 7 is divided from the rest of the top closure film 3 (which remains connected to the feed roll 2) and is constituted by a plurality of longitudinally separated and transversally adjacent distinct film sheets 7*a* (see FIGS. 1 and 6). Note that FIG. 1 shows that first one or more first blades 28*a* intervene on the top closure film 3 to form parallel cuts in the direction of movement of the top closure film and then one or more second blades 28*b* intervene to transversally cut the selected unrolled portion 7 thereby forming a plurality of adjacent separate film sheets 7*a* collectively defining the selected unrolled portion. However, the sequence of the cuts may be reversed or the longitudinal and transverse cuts may be made at the same time, for instance using a suitably shaped cutter or a suitably shaped die-cutter.

The separated unrolled portion 7 (see FIG. 6) is sized exactly to cover all supports 11 of a same row R present in the packaging station and to cover (in the direction perpendicular to alignment direction D) all rows of supports R present in the packaging station. In the example of FIG. 6, the lower tool 18 of a packaging station hosts eight seats and thus supports or trays positioned according to two rows of 4 seats/trays each; the transfer device 10 carries a selected unrolled portion 7 of top closure film formed by eight adjacent sheets 7*a* into the packaging station, such that each sheet 7*a* perfectly fits to the size of the respective tray flange 24 and may thus close, in particular gas tightly close, a corresponding one of the underlying supports/trays 11. More in general, the separated unrolled portion 7, once transferred to the packaging station, is engaged to the underlying supports 11 present in the lower tool load area 20 such that each one of the supports 11 is heat sealed to a respective part of the separated unrolled portion 7 or to a respective one of the distinct film sheets 7*a* (part of a same unrolled portion). FIG. 5 shows the example of a support 11, in the form of tray with side wall and peripheral flange, used in the process and with the apparatus of the invention: the tray 11 is closed by one respective film sheet 7*a* of the film sheets of one unrolled portion transported into the packaging assembly.

FIG. 7 shows the case where the top closure film 7*a* is heat sealed to the flange 24 to form a controlled atmosphere or a natural atmosphere package, while FIG. 8 is shows the case where the top closure film 7*a* is heat sealed to the flange 24 and to the top surface of the tray not occupied by the product to form a vacuum skin package.

Going now back to the transfer of the selected unrolled portion 7 into the packaging station, it is noted that the transfer device 10 used for effecting the transfer of the selected film portion 7 from the pick-up zone 6 to the packaging station 8 may comprise a transfer body 40, for example in the form of a plate or in any case of a relatively small thickness body, able to travel back and forth between the cutting station and the packaging station. The step of transferring the selected unrolled portion 7, after separation of this latter from the rest of the top closure film by the cutting station 9, provides for positioning the selected unrolled portion on a continuous active surface 40*a* of the transfer body: in the examples shown the active surface 40*a* is a top surface of the transfer body 40 which may be flat, slightly convex or slightly concave, and which keeps the selected unrolled portion 7 in position (also during the transfer displacement) under the constant action of a suction force exerted by sucking air through a plurality of suction holes 41 present on the same active surface 40*a* and connected to a vacuum source 42, this latter being controlled by the mentioned control unit 50. Then, with the packaging station 8 in the open configuration, the transferring step of the process provides for moving the transfer body 40 and thus the selected unrolled portion 7 (which has been just severed from the rest of the top closure film 3) from the cutting station 9 to the packaging station 8, underneath the upper tool 19, and for releasing the selected unrolled portion from the active surface of the transfer body, once the transfer body is just below and in proximity of the upper tool. The release may be controlled by the control unit 50 which is configured to command the vacuum source 42 to stop sucking air from the suction holes 41 or which may vent the suction holes 41 to the atmosphere by action of an appropriate valve system 43. The unrolled portion released by the transfer body 40 is then captured by a lower surface 19*a* of the upper tool 19, which may also be provided with a respective number of suction holes 19*b* connected to a vacuum source (which may be the same vacuum source 42 or another vacuum source 45) under the control of the control unit. At this point the transfer body 10 may be controlled to return to the cutting station 9. The described motion of the transfer body is controlled by the control unit commanding one or more actuators 46 acting on the transfer body 10 and controllably connected with the control unit. The control unit 10 is configured to synchronize the action by the cutting unit, the intervention of the vacuum sources, the opening/closing of the packaging station, the movement of the transfer body, the movement of the first conveyor and of the transfer mechanism, such as the apparatus 100 performs the described steps in the appropriate sequence as described without interference among the various moving parts.

In accordance with an alternative solution, the selected unrolled portion 7 is not transversally severed and separated from the rest of the top closing film 3 before being transferred into the packaging station 8. In this case there is no cutting unit between the film supply assembly 1 and the packaging station 8. Of course the transferring of the selected unrolled portion may take place as above described. On the other hand, in accordance with an alternative, which is for example shown in FIGS. 3 and 4, transferring of the selected unrolled portion 7 may take place by grasping the leading edge 7*b* of the selected unrolled portion 7 (i.e., the terminal free border extending in the widthwise direction of the top closure film) and moving the selected unrolled portion 7 from pick-up zone 6 outside the packaging station into the packaging station and above the lower tool loading area 20. In order to do this, one or more pincers 46 may operate to grasp the leading edge 7*b* of the selected unrolled portion; the pincers 46 may be engaged for instance to the upper tool or to another part of the apparatus 100 and be configured to travel back and forth in order to properly position the selected unrolled portion, at each cycle, in proper position inside the packaging station. For example the travelling pincers 46 may pick the unrolled selected portion 7 of top closure film at a zone 6 of the apparatus next to the packaging station 8 and pull the top closure film 3 in direction of and towards the packaging station to position the selected unrolled portion 7 under the upper tool and above the lower tool loading area. Then, once the packaging station has completed the fixing of the selected unrolled portion to the underlying supports present in the packaging station, the travelling pincers 46 may move back to their initial position and pick a new selected unrolled portion 7 to start a new packaging cycle. The one or more travelling pincers 46 acting on the leading edge 7*b* may cooperate with one or more fixed pincers 47 mounted either on the upper tool or on a fixed frame of the apparatus carrying the packaging station: the fixed pincers 47 may hold the top closure film 3 when the travelling pincers 46 move back to their initial position at the end of each packaging cycle.

In an auxiliary yet particularly advantageous aspect, the step of transferring the unrolled selected portion into the packaging station 8 is effected without grasping opposite longitudinal side borders of the selected unrolled portion: in other words, the selected unrolled portion is either transferred using the transfer body 40 or using the travelling pincers 46 described above: this means that there are no conveying elements such as pincers, or rollers or other means touching or grasping the longitudinal side borders of said selected unrolled portion. This not only avoids to damage the top closure film side borders, but saves a relatively large quantity of top closure film material because any means intervening on the side borders necessarily takes a band on each side of the top closure film which then cannot be used for closing the supports.

Once the packaging cycle is finished and the supports 11 have been closed by the selected unrolled portions of the closure film 3, the packaging station 8 moves to the open configuration and a further transfer mechanism 48 may extract the packaged products PP and move them onto a second conveyor 49 which may be opposite to the first conveyor 13 (as shown in the figures) or which may travel orthogonal to the first conveyor. In case of need, a package severing station 51 comprising one or more blades 52 may operate downstream the packaging station 8 to separate the packaged products the one from the other.

The invention claimed is:

1. A method of packaging:

positioning supports, with a respective product thereon, inside a packaging station, the packaging station comprising a lower tool and an upper tool cooperating with the lower tool, wherein:

the supports are positioned at a lower tool loading area in one or more rows of supports, each of the one or more rows of supports includes supports aligned along a predetermined alignment direction, and a number of the supports in each of the one or more rows of supports is greater than a number of support rows in the lower tool loading area or with the support loading area extending more along the alignment direction than perpendicularly to the alignment direction;

unrolling a top closure film from a feed roll of a film supplying station by allowing the feed roll to turn about a respective unwinding axis, the top closure film having a width measured parallel to the unwinding axis;

transferring a selected unrolled portion of the top closure film inside the packaging station, wherein the selected unrolled portion is a strip spanning across and having the width of the top closure film, and wherein the selected unrolled portion is positioned above the lower tool loading area with the width of the selected unrolled portion aligned to the alignment direction of the one or more of the rows of supports present in the lower tool loading area; and fixing the selected unrolled portion of the top closure film to the supports present in the packaging station;

wherein the supports are positioned at the lower tool loading area in correspondence of one or more rows of seats aligned along the alignment direction, and wherein each of the one or more row of seats comprises at least three seats to define a respective row of supports having at least three supports;

wherein the lower tool, at the lower tool loading area, has rows of seats aligned along the alignment direction and receives the supports positioned according to the rows of supports.

2. The method of claim 1, wherein the selected unrolled portion of the top closure film transferred inside the packaging station and above the lower tool loading area has:

a width sufficient to cover the extension along the alignment direction of the supports in the packaging station, and a length, measured perpendicular to the width, sufficient to cover the extension, perpendicular to the alignment direction, of the supports present in the packaging station.

3. The method of claim 1, wherein the selected unrolled portion of the top closure film transferred inside the packaging station and above the lower tool loading area has a rectangular shape.

4. The method of claim 1, wherein a number of seats on each of the one or more row of seats is at least twice the number of rows of seats present in the lower tool loading area.

5. The method of claim 1, wherein the process comprises repeating at intervals a packaging cycle comprising at least the following steps:

configuring the packaging station in an open configuration, where the upper and lower tools are spaced apart the one from the other, with the packaging station in the open configuration executing the step of positioning the supports, with at least a product loaded thereon, in the packaging station, executing the step of transferring the unrolled portion into the packaging station and above the lower tool loading area, configuring the packaging station in a closed configuration, wherein the upper and lower tools are approached to each other, with the packaging station in a closed configuration, fixing the top closure film to the supports, in particular heat sealing to the supports the selected portion the top closure film which has been transferred into the packaging station and above the lower tool loading area.

6. The method of claim 1, further comprising executing a cutting procedure at a cutting station operatively interposed between the supplying station and the transfer device, wherein the cutting station receives the top closure film and separates the selected unrolled portion from the top closure film before the selected unrolled portion is transferred inside the packaging station, wherein the cutting procedure comprises either:

transversally separating the selected unrolled portion from the top closure film, forming a separated unrolled portion, divided from the rest of the closure film coming from the feed roll, in the form of a unitary strip having the width of the top closure film; or transversally separating the selected unrolled portion from the top closure film and longitudinally dividing the closure film at the selected unrolled portion, forming a separated unrolled portion that includes a plurality of longitudinally separated and transversally adjacent distinct film sheets.

7. The method of claim 6, further wherein:

the separated unrolled portion is sized to cover the supports of one of the one or more rows of supports present in the packaging station and to cover the one or more rows of supports present in the packaging station; and after the separated unrolled portion is transferred into the sealing station, the separated unrolled portion is engaged to the underlying supports present in the lower tool load area such that each of the supports is fixed to a respective part of the separated unrolled portion or to a respective one of the distinct film sheets.

8. The method of claim 1, wherein:

the width of the top closure film, measured parallel to the unwinding axis, is at least 450 mm and the top closure film is a plastic film having a thickness between 10 and 200 μm; or the width of the top closure film, measured parallel to the unwinding axis, is at least 600 mm and the top closure film is extruded mono or multilayer plastic film.

9. A method of packaging:

positioning supports, with a respective product thereon, inside a packaging station, the packaging station comprising a lower tool and an upper tool cooperating with the lower tool, wherein:

the supports are positioned at a lower tool loading area in one or more rows of supports, each of the one or more rows of supports includes supports aligned along a predetermined alignment direction, and a number of the supports in each of the one or more rows of supports is greater than a number of support rows in the lower tool loading area or with the support loading area extending more along the alignment direction than perpendicularly to the alignment direction;

unrolling a top closure film from a feed roll of a film supplying station by allowing the feed roll to turn about a respective unwinding axis, the top closure film having a width measured parallel to the unwinding axis, transferring a selected unrolled portion of the top closure film inside the packaging station, wherein the selected unrolled portion is a strip spanning across and having the width of the top closure film, and wherein the selected unrolled portion is positioned above the lower tool loading area with the width of the selected unrolled portion aligned to the alignment direction of the one or more of the rows of supports present in the lower tool loading area;

fixing the selected unrolled portion of the top closure film to the supports present in the packaging station;

wherein the transferring comprises:

positioning the selected unrolled portion on an active surface of a transfer body; and with the packaging station in the open configuration:

moving the transfer body and the selected unrolled portion from the cutting station to the packaging station and underneath the upper tool, releasing the selected unrolled portion from the active surface of the transfer body and capturing the selected unrolled portion by a lower surface of the upper tool, and returning the transfer body to the cutting station.

10. The method of claim 9, wherein the active surface of the transfer body is flat and keeps the selected unrolled portion in position under a suction force exerted by sucking air through a plurality of suction holes present on the active surface and connected to a vacuum source.

11. An apparatus comprising:

a film supplying station configured to supply a top closure film, wherein the film supplying station is configured to engage at least one feed roll to rotate about a respective unwinding axis to allow unrolling of the top closure film from the feed roll, a packaging station having:

a lower tool that presents a lower tool loading area configured to receive a plurality of supports positioned according to one or more rows of supports, wherein:

each of the one or more rows of supports includes a plurality of supports aligned along a predetermined alignment direction, and a number of supports in each of the one or more rows of supports is greater than a number of rows of supports in the lower tool loading area, or the support loading area extending more along the alignment direction than perpendicularly to the alignment direction, an upper tool configured to cooperate with the lower tool for fixing the top closure film to the plurality of supports present in the packaging station; and a transfer device configured to:

act on a selected unrolled portion of the top closure film having the width, measured parallel to the unwinding axis, of the top closure film, and transfer the selected unrolled portion into the packaging station and above the lower tool loading area, with the width of the selected unrolled portion aligned to the alignment direction of the rows of supports in the lower tool loading area;

wherein:

the lower tool, at the lower tool loading area, has a plurality of parallel rows of seats aligned along the alignment direction and configured to receive the supports positioned according to the rows of supports; and a number of seats on each row of seats is at least twice a number of rows of seats present in the lower tool loading area.

12. The apparatus of claim 11, wherein:

the film supplying station is configured to engage the at least one feed roll to rotate about the respective unwinding axis which is parallel to the predetermined alignment direction;

the transfer device is configured to:

act on the selected unrolled portion located at a pick-up zone of the apparatus positioned between the film supplying station and the packaging station, transfer above the lower tool loading area, the selected unrolled portion of the top closure film; and the selected unrolled portion of the top closure film has:

a width sufficient to cover the extension, along the alignment direction, of the lower tool loading area, to cover the supports of one of the one or more rows of supports present in the packaging station, a length sufficient to cover the entire extension, perpendicular to the alignment direction, of the lower tool loading area, to cover the one or more rows of supports present in the packaging station.

13. The apparatus of claim 12, wherein the transfer device is configured to:

act on the selected unrolled portion located at the pick-up zone of the apparatus positioned between the film supplying station and the packaging station, and transfer above the lower tool loading area, the selected unrolled portion of the top closure film having width greater than the respective length.

14. The apparatus of claim 13, wherein the transfer device is configured to act on, and transfer above the lower tool loading area, the selected unrolled portion of the top closure film having a width at least twice the respective length.

15. The apparatus of claim 11, wherein the lower tool, at the lower tool loading area, has one or more rows of seats aligned along the alignment direction and configured to receive the supports positioned according to the one or more rows of supports and wherein each of the one or more rows of seats comprises at least three aligned seats.

16. The apparatus of claim 11, wherein the film supplying station is configured to engage one feed roll providing the top closure film of width, measured parallel to the unwinding axis, of at least 450 mm; and wherein the top closure film is a plastic film having a thickness between 10 and 200 μm.

17. The apparatus of claim 11, wherein the film supplying station is configured to engage one feed roll providing the top closure film of width, measured parallel to the unwinding axis, of at least at least 600 mm.

* * * * *